US011486616B2

(12) United States Patent
Takegami et al.

(10) Patent No.: US 11,486,616 B2
(45) Date of Patent: Nov. 1, 2022

(54) REFRIGERATION DEVICE

(71) Applicant: DAIKIN INDUSTRIES, LTD., Osaka (JP)

(72) Inventors: Masaaki Takegami, Osaka (JP); Takuya Horita, Osaka (JP); Akitoshi Ueno, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 108 days.

(21) Appl. No.: 17/037,221

(22) Filed: Sep. 29, 2020

(65) Prior Publication Data

US 2021/0063064 A1 Mar. 4, 2021

Related U.S. Application Data

(63) Continuation of application No. PCT/JP2019/014207, filed on Mar. 29, 2019.

(30) Foreign Application Priority Data

Mar. 30, 2018 (JP) ..... JP2018-068997

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01)

(58) Field of Classification Search
CPC .. F25B 5/00–04; F25B 6/00–04; F25B 13/00; F25B 41/20; F25B 41/22;
(Continued)

(56) References Cited

U.S. PATENT DOCUMENTS 4,878,357 A 11/1989 Sekigami et al.
7,237,405 B2 * 7/2007 Takegami ..... F25B 13/00 62/510
(Continued)

FOREIGN PATENT DOCUMENTS

EP 2 990 849 A1 8/2009
EP 2 924 359 A1 9/2015
(Continued)

OTHER PUBLICATIONS

International Search Report, dated in PCT/JP2019/014207, PCT/ISA/210, dated Jun. 18, 2019.
(Continued)

*Primary Examiner* — Miguel A Diaz
(74) *Attorney, Agent, or Firm* — Birch, Stewart, Kolasch & Birch, LLP

(57) ABSTRACT

A flow path switching mechanism (70) includes first to fourth flow paths (71, 72, 73, 74) and opening and closing mechanisms (V1, V2, V3, V4, 75, 76) that can each open and close a corresponding one of the flow paths (71, 72, 73, 74). A first connection point (C1) connecting an inflow portion of the first flow path (71) and an inflow portion of the second flow path (72) is connected to a discharge portion of a compression unit (30). A second connection point (C2) connecting an outflow portion of the first flow path (71) and an inflow portion of the third flow path (73) is connected to a gas-side end of a heat source heat exchanger (22). A third connection point (C3) connecting an outflow portion of the second flow path (72) and an inflow portion of the fourth flow path (74) is connected to a gas-side end of a second utilization heat exchanger (85, 93). A fourth connection point (C4) connecting an outflow portion of the third flow path (73) and an outflow portion of the fourth flow path (74), and a gas-side end of a first utilization heat exchanger (83)
(Continued)

are connected to a suction portion of the compression unit (30).

20 Claims, 20 Drawing Sheets

(58) Field of Classification Search
CPC ..... F25B 41/24; F25B 41/26; F25B 41/28; F25B 2309/06
See application file for complete search history.

(56) References Cited

U.S. PATENT DOCUMENTS

| | | | | |
|---|---|---|---|---|
| 7,587,909 | B2 * | 9/2009 | Yoon | F25B 13/00 62/324.1 |
| 8,091,377 | B2 * | 1/2012 | Jeong | F25B 13/00 62/200 |
| 8,307,668 | B2 * | 11/2012 | Kawano | F25B 31/004 62/193 |
| 9,851,132 | B2 * | 12/2017 | Kawano | F25B 41/20 |
| 2005/0115271 | A1 | 6/2005 | Takegami et al. | |
| 2006/0179868 | A1 * | 8/2006 | Yoon | F25B 13/00 62/324.1 |
| 2008/0022710 | A1 * | 1/2008 | Jeong | F25B 13/00 62/324.6 |
| 2009/0126399 | A1 * | 5/2009 | Takegami | F25B 47/022 62/510 |
| 2010/0089082 | A1 * | 4/2010 | Kawano | F25B 31/004 62/192 |
| 2011/0048054 | A1 * | 3/2011 | Sekine | F25B 13/00 62/335 |
| 2011/0174002 | A1 * | 7/2011 | Jang | F25B 13/00 62/115 |
| 2015/0292756 | A1 * | 10/2015 | Takenaka | F24F 5/001 62/160 |
| 2015/0300666 | A1 * | 10/2015 | Kawano | F24F 5/001 29/890.035 |
| 2015/0345842 | A1 * | 12/2015 | Kawano | F24F 3/08 62/196.1 |
| 2021/0063064 | A1 * | 3/2021 | Takegami | F25B 49/02 |

FOREIGN PATENT DOCUMENTS

| | | | | |
|---|---|---|---|---|
| EP | 3321606 | B1 * | 10/2021 | F24F 11/89 |
| JP | 1-167561 | A | 7/1989 | |
| JP | 3-181756 | A | 8/1991 | |
| JP | 2002-277098 | A | 9/2002 | |
| JP | 2003-139429 | A | 5/2003 | |
| JP | 2004-44921 | A | 2/2004 | |
| JP | 2013-210150 | A | 10/2013 | |
| JP | 2014-70829 | A | 4/2014 | |
| JP | 2021105511 | A * | 7/2021 | |
| WO | WO-2019189838 | A1 * | 10/2019 | F25B 13/00 |
| WO | WO-2020203708 | A1 * | 10/2020 | F25B 1/10 |

OTHER PUBLICATIONS

Extended European Search Report, dated Feb. 4, 2021, for European Application No. 19775885.7.

* cited by examiner

FIG.2

| OPERATING MODE | OPERATION | | COMPRESSOR | | VALVE | | | | |
|---|---|---|---|---|---|---|---|---|---|
| | REFRIGERATION FACILITY | INDOOR | 1 | 2 | V1 | V2 | V3 | V4 | V5 |
| REFRIGERATION -FACILITY OPERATION | OPERATED | STOPPED | ON | OFF | OPENED | CLOSED | CLOSED | CLOSED | CLOSED |
| | | | OFF | ON | OPENED | CLOSED | CLOSED | CLOSED | OPENED |
| | | | ON | ON | OPENED | CLOSED | CLOSED | CLOSED | OPENED |
| COOLING OPERATION | STOPPED | COOLING | ON | OFF | OPENED | CLOSED | CLOSED | OPENED | OPENED |
| | | | OFF | ON | OPENED | CLOSED | CLOSED | OPENED | CLOSED |
| | | | ON | ON | OPENED | CLOSED | CLOSED | OPENED | OPENED |
| COOLING AND REFRIGERATION-FACILITY OPERATION | OPERATED | COOLING | ON | ON | OPENED | CLOSED | CLOSED | OPENED | CLOSED |
| HEATING OPERATION | STOPPED | HEATING | ON | OFF | CLOSED | OPENED | OPENED | CLOSED | OPENED |
| | | | OFF | ON | CLOSED | OPENED | OPENED | CLOSED | CLOSED |
| | | | ON | ON | CLOSED | OPENED | OPENED | CLOSED | OPENED |
| HEATING AND REFRIGERATION-FACILITY OPERATION | OPERATED | HEATING | ON | ON | CLOSED | OPENED | OPENED | CLOSED | CLOSED |
| HEATING AND REFRIGERATION-FACILITY HEAT RECOVERY OPERATION | OPERATED | HEATING | ON | OFF | CLOSED | OPENED | OPENED | CLOSED | CLOSED |
| | | | OFF | ON | CLOSED | OPENED | OPENED※ | CLOSED | OPENED |
| | | | ON | ON | CLOSED | OPENED | OPENED※ | CLOSED | OPENED |
| HEATING AND REFRIGERATION-FACILITY RESIDUAL HEAT OPERATION | OPERATED | HEATING | ON | OFF | OPENED | OPENED | CLOSED | CLOSED | CLOSED |
| | | | OFF | ON | OPENED | OPENED | CLOSED | CLOSED | OPENED |
| | | | ON | ON | OPENED | OPENED | CLOSED | CLOSED | OPENED |
| DEFROST OPERATION | OPERATED | DEFROSTING | ON | ON | OPENED | CLOSED | CLOSED | OPENED | CLOSED |

※: CLOSED WHEN CONDITION A IS SATISFIED

COOLING OPERATION (DEFROST OPERATION)

FIG.6 HEATING OPERATION

HEATING AND REFRIGERATION-FACILITY HEAT RECOVERY OPERATION

FIG.9 HEATING AND REFRIGERATION-FACILITY RESIDUAL HEAT OPERATION

FIG.11

HIGH ← REQUIRED HEATING CAPACITY → LOW

| HEATING AND REFRIGERATION-FACILITY OPERATION | | HEATING AND REFRIGERATION-FACILITY HEAT RECOVERY OPERATION | | HEATING AND REFRIGERATION-FACILITY RESIDUAL HEAT OPERATION |
|---|---|---|---|---|
| ・CLOSE V1 AND V4<br>・OPEN V2 AND V3 | →<br>・GRADUALLY DECREASE OPENING DEGREE OF V3 | ・CLOSE V1, V3, AND V4<br>・OPEN V2 | →<br>・GRADUALLY INCREASE OPENING DEGREE OF V1 | ・OPEN V1 AND V2<br>・CLOSE V3 AND V4 |
| | ←<br>・GRADUALLY INCREASE OPENING DEGREE OF V3 | | ←<br>・GRADUALLY DECREASE OPENING DEGREE OF V1 | |

COOLING AND REFRIGERATION-FACILITY OPERATION

HEATING AND REFRIGERATION-FACILITY OPERATION

HEATING AND REFRIGERATION-FACILITY HEAT RECOVERY OPERATION

HEATING AND REFRIGERATION-FACILITY RESIDUAL HEAT OPERATION

REFRIGERATION DEVICE

CROSS REFERENCE TO RELATED APPLICATIONS

This application is a Continuation of PCT International Application No. PCT/JP2019/014207 filed on Mar. 29, 2019, which claims priority under 35 U.S.C. § 119(a) to Patent Application No. 2018-068997 filed in Japan on Mar. 30, 2018, all of which are hereby expressly incorporated by reference into the present application.

TECHNICAL FIELD

The present disclosure relates to a refrigeration device.

BACKGROUND ART

The refrigeration device disclosed in Patent Literature 1 includes a refrigerant circuit to which a compressor (compression unit), an outdoor heat exchanger (heat source heat exchanger), a refrigeration-facility heat exchanger (first utilization heat exchanger), and an indoor heat exchanger (second utilization heat exchanger) are connected. The refrigerant circuit is provided with two four-way switching valves as a flow path switching mechanism. The refrigeration device makes it possible to perform at least the following four operations by switching the states of the two four-way switching valves.

In a first operation (cooling and refrigeration-facility operation), compressed refrigerant radiates heat (condenses) in the outdoor heat exchanger and evaporates in the refrigeration-facility heat exchanger and the indoor heat exchanger. In a second operation (heating and refrigeration-facility operation), the compressed refrigerant radiates heat in the indoor heat exchanger and evaporates in the refrigeration-facility heat exchanger and the outdoor heat exchanger. In a third operation (heating and refrigeration-facility heat recovery operation), the compressed refrigerant radiates heat in the indoor heat exchanger and evaporates in the refrigeration-facility heat exchanger, and the outdoor heat exchanger is stopped. In a fourth operation (heating and refrigeration-facility residual heat operation), the compressed refrigerant radiates heat in the indoor heat exchanger and the outdoor heat exchanger and evaporates in the refrigeration-facility heat exchanger.

CITATION LIST

Patent Literature

[Patent Literature 1] JP 2004-44921 A

SUMMARY

A first aspect is a refrigeration device including a refrigerant circuit (11) to which a compression unit (30), a heat source heat exchanger (22), a first utilization heat exchanger (83) and a second utilization heat exchanger (85, 93) connected in parallel to the heat source heat exchanger (22), and a flow path switching mechanism (70) that switches flow of refrigerant are connected, wherein the flow path switching mechanism (70) includes first to fourth flow paths (71, 72, 73, 74) and an opening and closing mechanism (V1, V2, V3, V4, 75, 76) that opens and closes a corresponding one of the flow paths (71, 72, 73, 74), a first connection point (C1) connecting an inflow portion of the first flow path (71) and an inflow portion of the second flow path (72) is connected to a discharge portion of the compression unit (30), a second connection point (C2) connecting an outflow portion of the first flow path (71) and an inflow portion of the third flow path (73) is connected to a gas-side end of the heat source heat exchanger (22), a third connection point (C3) connecting an outflow portion of the second flow path (72) and an inflow portion of the fourth flow path (74) is connected to a gas-side end of the second utilization heat exchanger (93), and a fourth connection point (C4) connecting an outflow portion of the third flow path (73) and an outflow portion of the fourth flow path (74), and a gas-side end of the first utilization heat exchanger (83) are connected to a suction portion of the compression unit (30).

BRIEF DESCRIPTION OF THE DRAWINGS

FIG. 2 is a table in which operating modes are compared.

FIG. 11 is a table illustrating transition of operating modes during heating.

DESCRIPTION OF EMBODIMENTS

An embodiment of the present disclosure will be described below with reference to the drawings. The following embodiment is an essentially preferred example, and is not intended to limit the scope of the present disclosure, matters to which the present disclosure is applicable, or the usage of the present disclosure.

Embodiment

<Entire Configuration>

Figure 1:
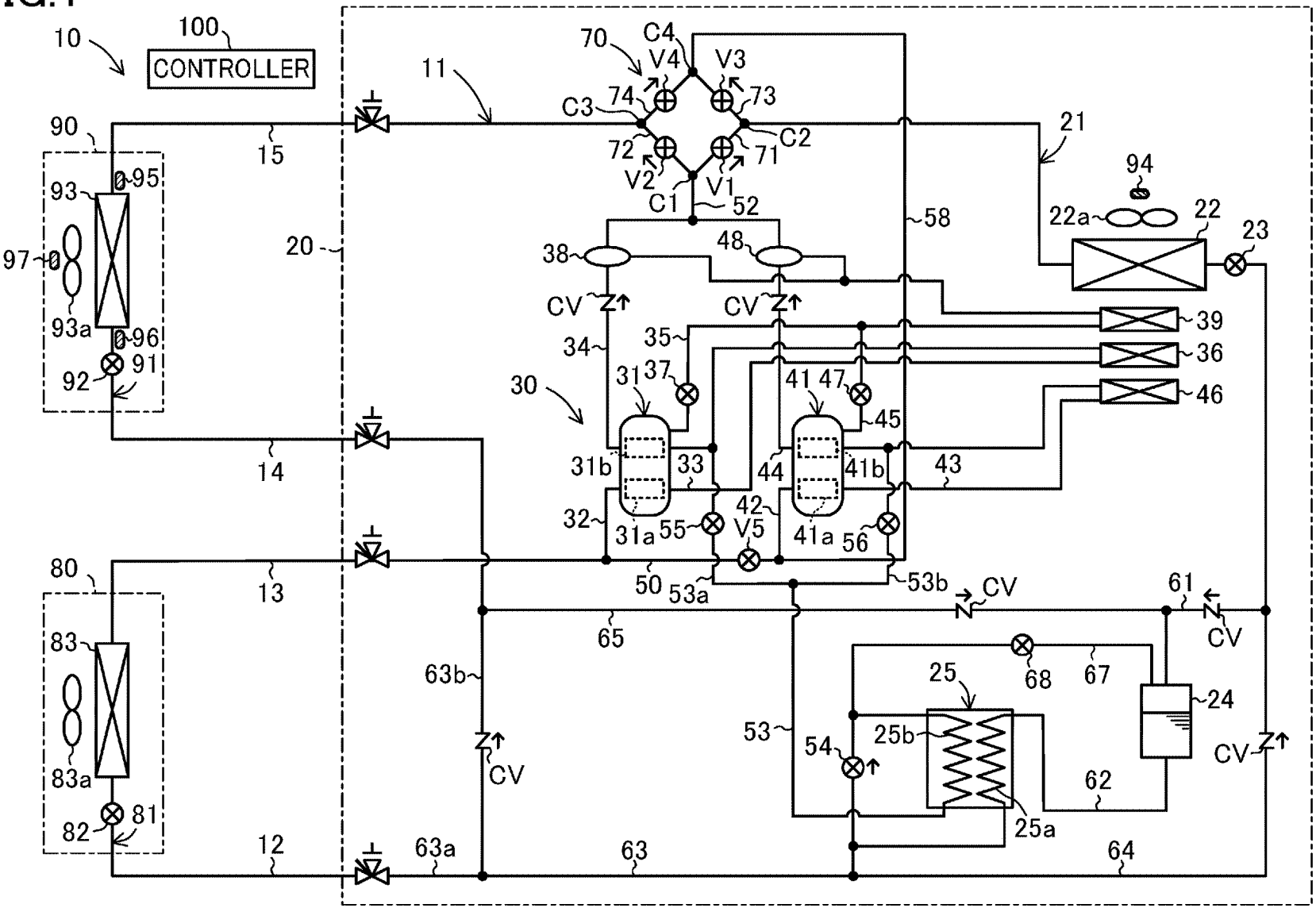
FIG. 1 is a piping system diagram of a refrigeration device according to an embodiment.

A refrigeration device (10) according to the embodiment simultaneously performs air conditioning in a room and cools air in an interior space of a refrigerating facility and a freezing facility (hereinafter, collectively referred to as a refrigeration facility) such as a refrigerator, a freezer, and a showcase mainly used for commercial purposes. As illustrated in FIG. 1, the refrigeration device (10) includes an outdoor unit (20) installed outdoors, a refrigeration-facility unit (80) that cools interior air, an indoor unit (90) for air conditioning of a room, and a controller (100). The numbers of the refrigeration-facility units (80) and the indoor units (90) are each not limited to one, but may be two or more, for example. These units (20, 80, 90) are connected to one another by four connection pipes (12, 13, 14, 15) to thereby form a refrigerant circuit (11). In the refrigerant circuit (11), a refrigeration cycle is performed based on circulation of refrigerant. The refrigerant in the refrigerant circuit (11) of the present embodiment is carbon dioxide.

<Outdoor Unit>

The outdoor unit (20) is installed outdoors. The outdoor unit (20) is provided with an outdoor circuit (21). A first compressor (31), a second compressor (41), an outdoor heat exchanger (22), an outdoor expansion valve (23), a receiver (24), and a subcooling heat exchanger (25) are connected to the outdoor circuit (21).

The first compressor (31) and the second compressor (41) constitute a compression unit (30) that compresses the refrigerant. The first compressor (31) and the second compressor (41) are of a two-stage compression type. The first compressor (31) and the second compressor (41) are of a variable displacement type with a variable number of rotations.

The first compressor (31) includes a first lower compression mechanism (31*a*) and a first upper compression mechanism (31*b*). In the first compressor (31), the refrigerant compressed by the first lower compression mechanism (31*a*) is further compressed by the first upper compression mechanism (31*b*). A first suction pipe (32), a first relay pipe (33), a first discharge pipe (34), and a first oil return pipe (35) are connected to the first compressor (31). The first suction pipe (32) communicates with a suction port of the first lower compression mechanism (31*a*). An inflow end of the first relay pipe (33) communicates with a discharge port of the first lower compression mechanism (31*a*). An outflow end of the first relay pipe (33) communicates with a suction port of the first upper compression mechanism (31*b*). The first discharge pipe (34) communicates with a discharge port of the first upper compression mechanism (31*b*). A first intercooler (36) is connected to the first relay pipe (33). A first flow rate adjustment valve (37) having a variable opening degree is connected to the first oil return pipe (35).

The second compressor (41) includes a second lower compression mechanism (41*a*) and a second upper compression mechanism (41*b*). In the second compressor (41), the refrigerant compressed by the second lower compression mechanism (41*a*) is further compressed by the second upper compression mechanism (41*b*). A second suction pipe (42), a second relay pipe (43), a second discharge pipe (44), and a second oil return pipe (45) are connected to the second compressor (41). The second suction pipe (42) communicates with a suction port of the second lower compression mechanism (41*a*). An inflow end of the second relay pipe (43) communicates with a discharge port of the second lower compression mechanism (41*a*). An outflow end of the second relay pipe (43) communicates with a suction port of the second upper compression mechanism (41*b*). The second discharge pipe (44) communicates with a discharge port of the second upper compression mechanism (41*b*). A second intercooler (46) is connected to the second relay pipe (43). A second flow rate adjustment valve (47) having a variable opening degree is connected to the second oil return pipe (45).

A first oil separator (38) is connected to the first discharge pipe (34). A second oil separator (48) is connected to the second discharge pipe (44). The oil separated by the first oil separator (38) and the oil separated by the second oil separator (48) are cooled by an oil cooler (39). The oil cooled by the oil cooler (39) is returned to the first compressor (31) via the first oil return pipe (35). The oil cooled by the oil cooler (39) is returned to the second compressor (41) via the second oil return pipe (45).

A suction communication pipe (50) is connected between the first suction pipe (32) and the second suction pipe (42). The suction communication pipe (50) is provided with a pressure adjustment valve (V5) having a variable opening degree. An outflow end of the first discharge pipe (34) and an outflow end of the second discharge pipe (44) are connected to a merged discharge pipe (52).

A bridge circuit (70) constitutes a flow path switching mechanism. The bridge circuit (70) includes first to fourth flow paths (71, 72, 73, 74) connected in a bridged manner and four valves (V1, V2, V3, V4) that can open and close the respective flow paths (71, 72, 73, 74). The first valve (V1), the second valve (V2), the third valve (V3), and the fourth valve (V4) are connected to the first flow path (71), the second flow path (72), the third flow path (73), and the fourth flow path (74), respectively. In the present embodiment, all of the four valves (V1, V2, V3, V4) are flow rate adjustment valves having a variable opening degree. The four valves (V1, V2, V3, V4) each have a backflow prevention mechanism. Specifically, the valves (V1, V2, V3, V4) allow the refrigerant to flow in the directions indicated by the arrows in FIG. 1, while prohibiting the refrigerant from flowing in the opposite directions.

The four valves (V1, V2, V3, V4) constitute opening and closing mechanisms that open and close the first to fourth flow paths (71, 72, 73, 74), respectively.

The bridge circuit (70) includes four (i.e., first to fourth) connection points (C1, C2, C3, C4). The first connection point (C1) connects an inflow portion of the first flow path (71) and an inflow portion of the second flow path (72). The second connection point (C2) connects an outflow portion of the first flow path (71) and an inflow portion of the third flow path (73). The third connection point (C3) connects an outflow portion of the second flow path (72) and an inflow portion of the fourth flow path (74). The fourth connection point (C4) connects an outflow portion of the third flow path (73) and an outflow portion of the fourth flow path (74).

The first connection point (C1) is connected to the first discharge pipe (34) and the second discharge pipe (44) (a discharge portion of the compression unit (30)). The second connection point (C2) is connected to a gas-side end of the outdoor heat exchanger (22) (heat source heat exchanger). The third connection point (C3) is connected to a gas-side end of an indoor heat exchanger (93) (second utilization heat exchanger). The fourth connection point (C4) is connected to the second suction pipe (42) (a suction portion of the compression unit (30)).

The outdoor heat exchanger (22) constitutes the heat source heat exchanger. The outdoor heat exchanger (22) is a fin-and-tube heat exchanger. An outdoor fan (22*a*) is provided near the outdoor heat exchanger (22). The refrigerant flowing through the outdoor heat exchanger (22) exchanges heat with air blown by the outdoor fan (22*a*). The first intercooler (36), the second intercooler (46), the oil cooler (39), and the outdoor heat exchanger (22) are disposed adjacent to each other in order to share the outdoor fan (22*a*) and fins (not illustrated).

A first pipe (61) is connected between the outdoor heat exchanger (22) and the receiver (24). The outdoor expansion valve (23) is connected to the first pipe (61). The outdoor expansion valve (23) is an electronic expansion valve having a variable opening degree.

The receiver (24) constitutes a container that stores the refrigerant. The subcooling heat exchanger (25) includes a high pressure-side flow path (25*a*) and a low pressure-side flow path (25*b*). In the subcooling heat exchanger (25), the refrigerant flowing through the high pressure-side flow path (25*a*) and the refrigerant flowing through the low pressure-side flow path (25*b*) exchange heat with each other.

A second pipe (62) is connected between the receiver (24) and the high pressure-side flow path (25*a*) of the subcooling heat exchanger (25). One end of a third pipe (63) is connected to an outflow portion of the high pressure-side flow path (25*a*) of the subcooling heat exchanger (25). A first liquid branch pipe (63*a*) and a second liquid branch pipe (63*b*) are connected to the other end of the third pipe (63). The first liquid branch pipe (63*a*) is connected to a liquid-side end of a refrigeration-facility heat exchanger (83) via a first liquid connection pipe (12). The second liquid branch pipe (63*b*) is connected to a liquid-side end of the indoor heat exchanger (93) via a second liquid connection pipe (14).

One end of an introduction pipe (53) is connected to the third pipe (63). A decompressing valve (54) and the high pressure-side flow path (25*a*) are connected to parts of the introduction pipe (53). The decompressing valve (54) has a backflow prevention mechanism. The decompressing valve (54) allows the refrigerant to flow in the direction indicated by the arrow in FIG. 1, while prohibiting the refrigerant from flowing in the opposite direction.

An inflow end of a first introduction branch pipe (53*a*) and an inflow end of a second introduction branch pipe (53*b*) are connected to the other end of the introduction pipe (53). An outflow end of the first introduction branch pipe (53*a*) is connected to the first relay pipe (33). An outflow end of the second introduction branch pipe (53*b*) is connected to the second relay pipe (43). A third flow rate adjustment valve (55) having a variable opening degree is connected to the first introduction branch pipe (53*a*). A fourth flow rate adjustment valve (56) having a variable opening degree is connected to the second introduction branch pipe (53*b*).

A fourth pipe (64) is connected between the first pipe (61) and the third pipe (63). A fifth pipe (65) is connected between the first pipe (61) and the second liquid branch pipe (63*b*). One end of a gas vent pipe (67) is connected to the top of the receiver (24). The other end of the gas vent pipe (67) is connected to the introduction pipe (53). A gas vent valve (68) is connected to the gas vent pipe (67). The gas vent valve (68) is an expansion valve having a variable opening degree.

The first discharge pipe (34), the second discharge pipe (44), the first pipe (61), the fourth pipe (64), the fifth pipe (65), and the second liquid branch pipe (63*b*) mentioned above are each provided with a check valve (CV). Each check valve (CV) allows the refrigerant to flow in the direction indicated by the corresponding arrow in FIG. 1, while prohibiting the refrigerant from flowing in the opposite direction.

<Refrigeration-Facility Unit>

The refrigeration-facility unit (80) is installed in, for example, a refrigerating warehouse. The refrigeration-facility unit (80) is provided with a refrigeration-facility circuit (81). The first liquid connection pipe (12) is connected to a liquid-side end of the refrigeration-facility circuit (81). A first gas connection pipe (13) is connected to a gas-side end of the refrigeration-facility circuit (81). The refrigeration-facility circuit (81) is provided with a refrigeration-facility expansion valve (82) and the refrigeration-facility heat exchanger (83) in that order from the liquid-side end. The refrigeration-facility expansion valve (82) is an electronic expansion valve having a variable opening degree.

The refrigeration-facility heat exchanger (83) constitutes a first utilization heat exchanger. The refrigeration-facility heat exchanger (83) is a fin-and-tube heat exchanger. An interior fan (83*a*) is provided near the refrigeration-facility heat exchanger (83). The refrigerant flowing through the refrigeration-facility heat exchanger (83) exchanges heat with air blown by the interior fan (83*a*). The gas-side end of the refrigeration-facility heat exchanger (83) is connected to the first suction pipe (32) of the first compressor (31) via the first gas connection pipe (13).

<Indoor Unit>

The indoor unit (90) is installed indoors. The indoor unit (90) is provided with an indoor circuit (91). A second gas connection pipe (15) is connected to a gas-side end of the indoor circuit (91). The second liquid connection pipe (14) is connected to a liquid-side end of the indoor circuit (91). The indoor circuit (91) is provided with an indoor expansion valve (92) and the indoor heat exchanger (93) in that order from the liquid-side end. The indoor expansion valve (92) is an electronic expansion valve having a variable opening degree.

The indoor heat exchanger (93) constitutes the second utilization heat exchanger. The indoor heat exchanger (93) is a fin-and-tube heat exchanger. An indoor fan (93*a*) is provided near the indoor heat exchanger (93). The refrigerant flowing through the indoor heat exchanger (93) exchanges heat with air blown by the indoor fan (93*a*). The gas-side end of the indoor heat exchanger (93) is connected to the second suction pipe (42) of the second compressor (41) via the second gas connection pipe (15), the fourth flow path (74) of the bridge circuit (70), and a suction relay pipe (58).

<Sensor>

The refrigeration device (10) is provided with various sensors. Examples of indices detected by these sensors include: the temperature and pressure of high-pressure refrigerant, the temperature and pressure of low-pressure refrigerant, and the temperature and pressure of intermediate-pressure refrigerant in the refrigerant circuit (11); the temperature of refrigerant in the outdoor heat exchanger (22); the temperature of refrigerant in the refrigeration-facility heat exchanger (83); the temperature of refrigerant in the indoor heat exchanger (93); the degree of suction superheating of each of the compressors (31, 41); the degree of discharge superheating of each of the compressors (31, 41); the temperature of outdoor air; the temperature of interior air; and the temperature of indoor air.

Note that FIG. 1 illustrates, among these sensors, an outdoor air temperature sensor (94), a first refrigerant temperature sensor (95), a second refrigerant temperature sensor (96), and an indoor air temperature sensor (97), which will be described in detail below.

<Controller>

The controller (100) serving as a control unit includes a microcomputer mounted on a control board and a memory device (specifically, a semiconductor memory) that stores software for operating the microcomputer. The controller (100) controls each unit of the refrigeration device (10) based on an operation command and detection signals of the sensors. The operation of the refrigeration device (10) is switched through control of each unit by the controller (100).

—Operation—

The operation of the refrigeration device (10) will be described in detail. As indicated in FIG. 2, the operation of the refrigeration device (10) includes a refrigeration-facility operation, a cooling operation, a cooling and refrigeration-facility operation, a heating operation, a heating and refrigeration-facility operation, a heating and refrigeration-facility heat recovery operation, a heating and refrigeration-facility residual heat operation, and a defrost operation.

During the refrigeration-facility operation, the refrigeration-facility unit (80) is operated and the indoor unit (90) is stopped. During the cooling operation, the refrigeration-facility unit (80) is stopped and the indoor unit (90) performs cooling. During the cooling and refrigeration-facility operation, the refrigeration-facility unit (80) is operated and the indoor unit (90) performs cooling. During the heating operation, the refrigeration-facility unit (80) is stopped and the indoor unit (90) performs heating. During each of the heating and refrigeration-facility operation, the heating and refrigeration-facility heat recovery operation, and the heating and refrigeration-facility residual heat operation, the refrigeration-facility unit (80) is operated and the indoor unit (90) performs heating. During the defrost operation, the refrigeration-facility unit (80) is operated to melt the frost on the surface of the outdoor heat exchanger (22).

The heating and refrigeration-facility operation is executed under the condition that a required heating capacity of the indoor unit (90) is relatively high. The heating and refrigeration-facility residual heat operation is executed under the condition that the required heating capacity of the indoor unit (90) is relatively low. The heating and refrigeration-facility heat recovery operation is executed under the condition that the required heating capacity of the indoor unit (90) is between that of the heating operation and that of the refrigeration-facility operation (condition that the refrigeration-facility operation and the heating operation are balanced).

As indicated in FIG. 2, during each operation, one or both of the first compressor (31) and the second compressor (41) are operated. In a case where only the first compressor (31) is operated, the pressure adjustment valve (V5) is closed. In a case where only the second compressor (41) is operated, the pressure adjustment valve (V5) is opened. In a case where the first compressor (31) and the second compressor (41) are operated, the pressure adjustment valve (V5) is opened. In the following description of each operation, the case where the first compressor (31) and the second compressor (41) are operated will be exemplified.

<Refrigeration-Facility Operation>

Figure 3:
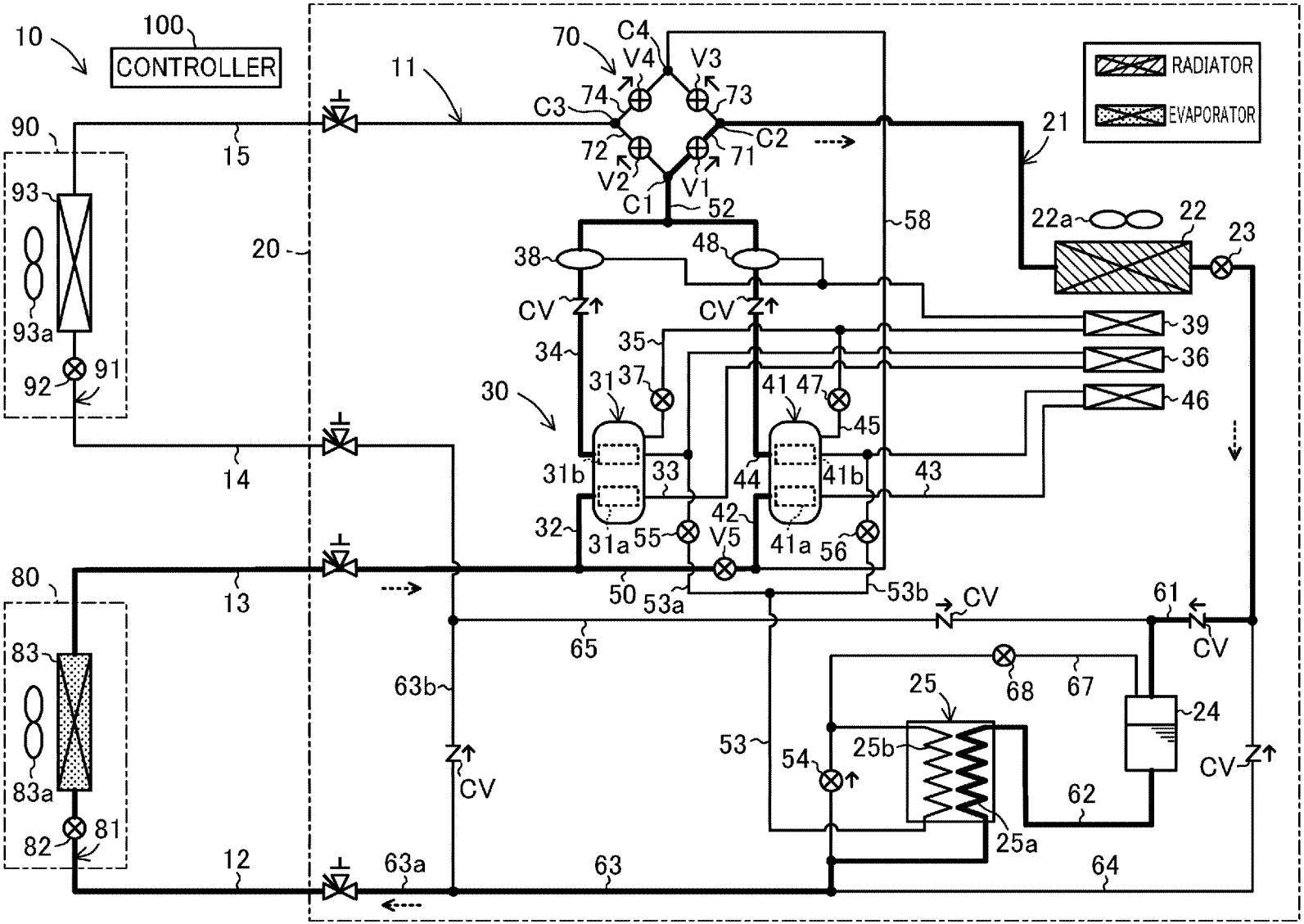
FIG. 3 is a diagram corresponding to FIG. 1, illustrating the flow of refrigerant in a refrigeration-facility operation.

During the refrigeration-facility operation illustrated in FIG. 3, the first valve (V1) is opened, while the second valve (V2), the third valve (V3), and the fourth valve (V4) are closed. The outdoor expansion valve (23) is fully opened, the opening degree of the refrigeration-facility expansion valve (82) is adjusted through superheating control, and the indoor expansion valve (92) is fully closed. A refrigeration cycle is performed in which the refrigerant compressed in the compression unit (30) radiates heat in the outdoor heat exchanger (22) and evaporates in the refrigeration-facility heat exchanger (83).

Specifically, the refrigerant compressed in the first compressor (31) and the second compressor (41) flows through the outdoor heat exchanger (22) via the first flow path (71) of the bridge circuit (70). At the outdoor heat exchanger (22), the heat of the refrigerant is released to the outdoor air. The refrigerant that has radiated heat in the outdoor heat exchanger (22) flows through the refrigeration-facility heat exchanger (83) via the receiver (24) and the high pressure-side flow path (25*a*) of the subcooling heat exchanger (25). In the refrigeration-facility heat exchanger (83), the interior air is cooled by the evaporating refrigerant. The refrigerant evaporated in the refrigeration-facility heat exchanger (83) is sucked into the first compressor (31) and the second compressor (41).

During the refrigeration-facility operation and other operations, a refrigerant cooling operation is appropriately performed as follows for cooling the intermediate-pressure refrigerant. At least part of the refrigerant compressed by the first lower compression mechanism (31*a*) of the first compressor (31) flows through the first intercooler (36) via the first relay pipe (33). At the first intercooler (36), the heat of the refrigerant is released to the outdoor air. The refrigerant cooled by the first intercooler (36) is further compressed by the first upper compression mechanism (31*b*) of the first compressor (31). Similarly, at least part of the refrigerant compressed by the second lower compression mechanism (41*a*) of the second compressor (41) flows through the second intercooler (46) via the second relay pipe (43). At the second intercooler (46), the heat of the refrigerant is released to the outdoor air. The refrigerant cooled by the second intercooler (46) is further compressed by the second upper compression mechanism (41*b*) of the second compressor (41).

During the refrigeration-facility operation and other operations, an injection operation is appropriately performed for introducing, into the compressors (31, 41), the refrigerant that has flowed through the low pressure-side flow path (25*b*) of the subcooling heat exchanger (25). Note that in each drawing, the flow of the refrigerant during the injection operation is not illustrated. Part of the refrigerant in the second pipe (62) flows into the introduction pipe (53). The gas refrigerant in the receiver (24) flows into the introduction pipe (53) via the gas vent pipe (67). The refrigerant that has flowed into the introduction pipe (53) is decompressed by the decompressing valve (54) and then flows through the low pressure-side flow path (25*b*). In the refrigeration-facility heat exchanger (83), the heat of the refrigerant flowing through the high pressure-side flow path (25*a*) is applied to the refrigerant flowing through the low pressure-side flow path (25*b*). The refrigerant that has flowed out of the low pressure-side flow path (25*b*) is branched off and flows into the first introduction branch pipe (53*a*) and the second introduction branch pipe (53*b*). The refrigerant in the first introduction branch pipe (53*a*) is introduced into the first upper compression mechanism (31*b*) of the first compressor (31) via the first relay pipe (33). The refrigerant in the second introduction branch pipe (53*b*) is introduced into the second upper compression mechanism (41*b*) of the second compressor (41) via the second relay pipe (43).

<Cooling Operation>

Figure 4:
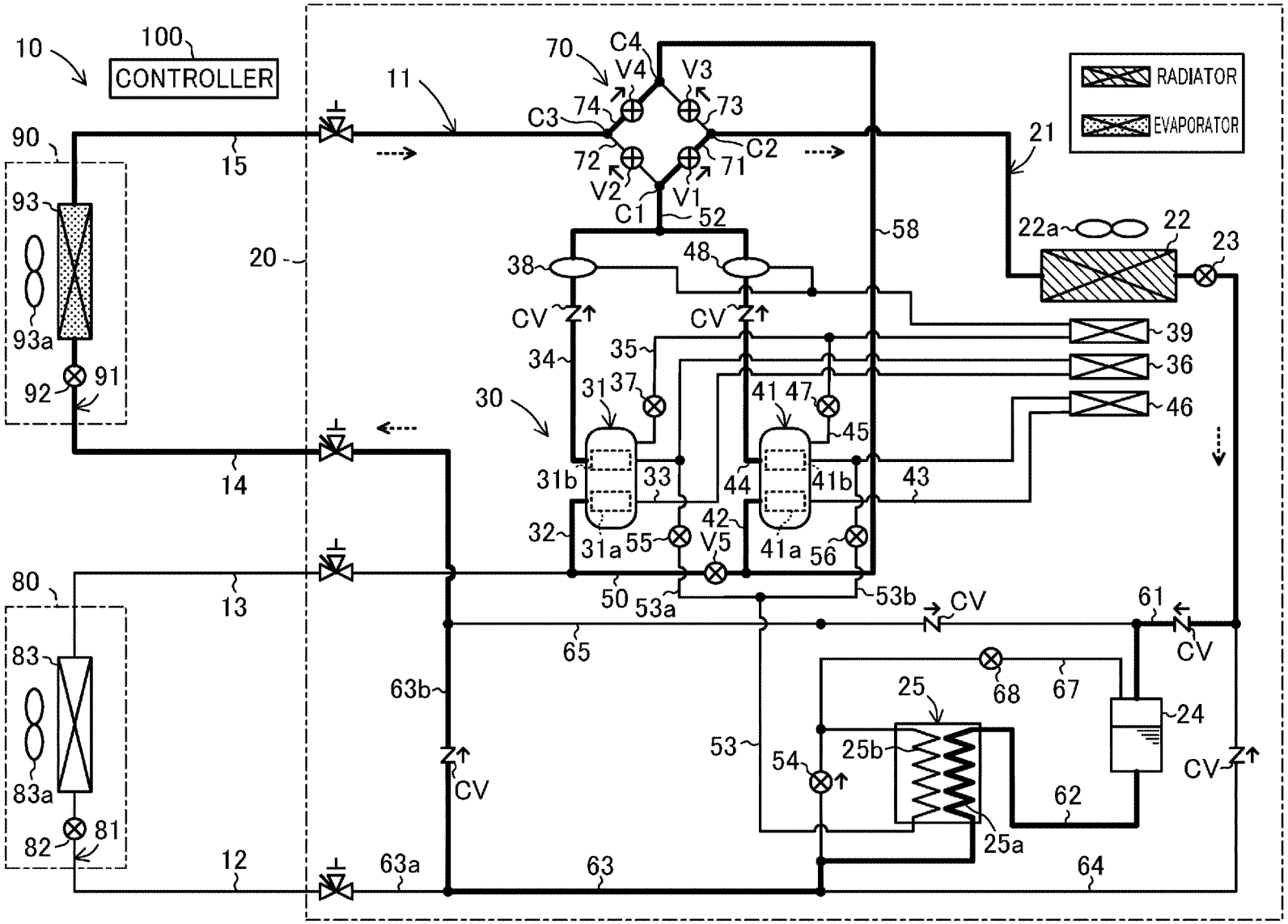
FIG. 4 is a diagram corresponding to FIG. 1, illustrating the flow of refrigerant in a cooling operation.

During the cooling operation illustrated in FIG. 4, the first valve (V1) and the fourth valve (V4) are opened, while the second valve (V2) and the third valve (V3) are closed. The outdoor expansion valve (23) is fully opened, the refrigeration-facility expansion valve (82) is fully closed, and the opening degree of the indoor expansion valve (92) is controlled through superheating control. A refrigeration cycle is performed in which the refrigerant compressed in the compression unit (30) radiates heat in the outdoor heat exchanger (22) and evaporates in the refrigeration-facility heat exchanger (83).

Specifically, the refrigerant compressed in the first compressor (31) and the second compressor (41) flows through the outdoor heat exchanger (22) via the first flow path (71) of the bridge circuit (70). At the outdoor heat exchanger (22), the heat of the refrigerant is released to the outdoor air. The refrigerant that has radiated heat in the outdoor heat exchanger (22) flows through the indoor heat exchanger (93) via the receiver (24) and the high pressure-side flow path (25*a*) of the subcooling heat exchanger (25). In the indoor heat exchanger (93), the indoor air is cooled by the evaporating refrigerant. The refrigerant evaporated in the indoor heat exchanger (93) is sucked into the first compressor (31) and the second compressor (41) via the fourth flow path (74) of the bridge circuit (70) and the suction relay pipe (58).

<Cooling and Refrigeration-Facility Operation>

Figure 5:
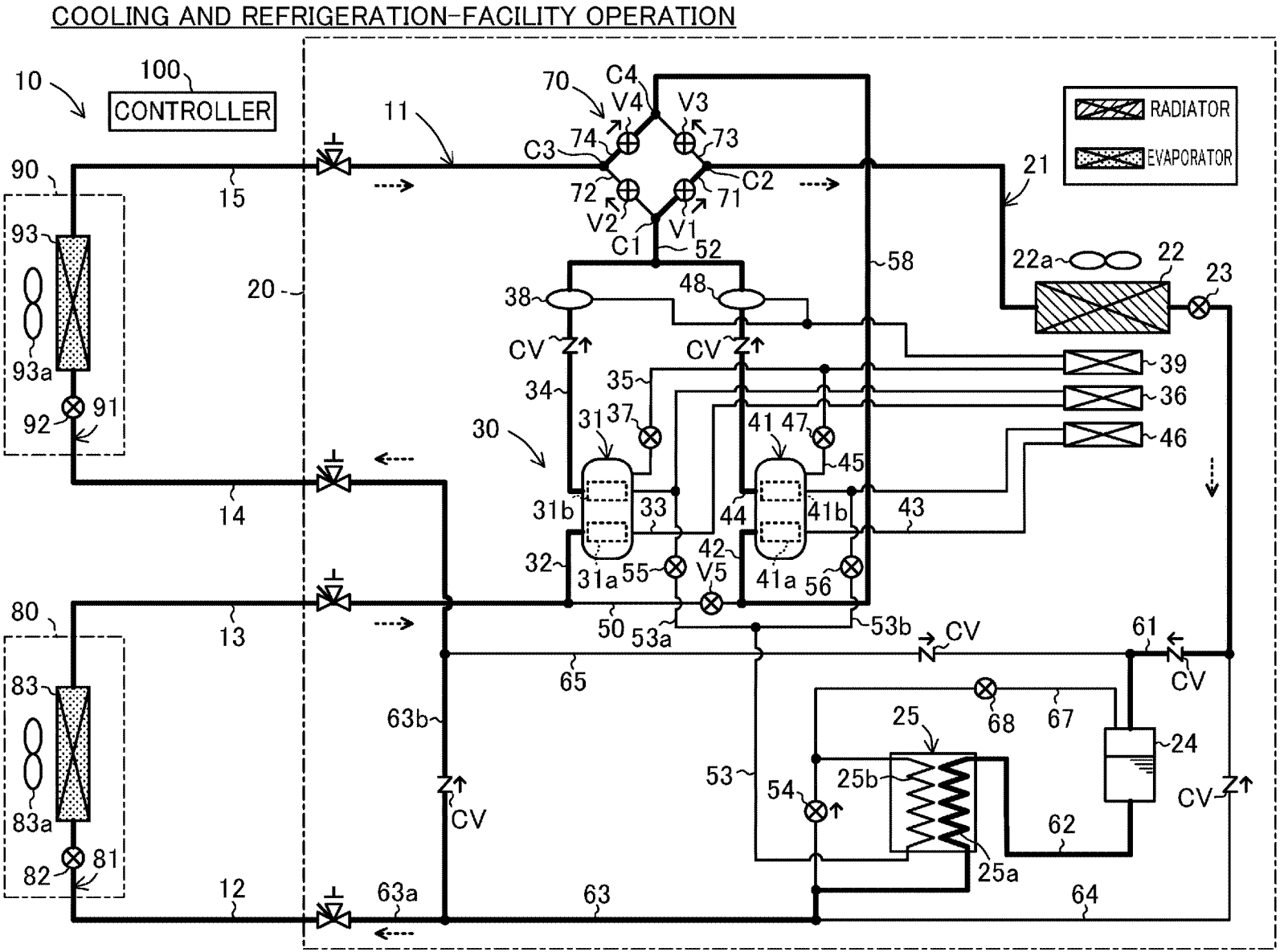
FIG. 5 is a diagram corresponding to FIG. 1, illustrating the flow of refrigerant in a cooling and refrigeration-facility operation.

During the cooling and refrigeration-facility operation illustrated in FIG. 5, the first valve (V1) and the fourth valve (V4) are opened, while the second valve (V2) and the third valve (V3) are closed. The outdoor expansion valve (23) is fully opened, and the opening degrees of the refrigeration-facility expansion valve (82) and the indoor expansion valve (92) are controlled through superheating control. A refrigeration cycle is performed in which the refrigerant compressed in the compression unit (30) radiates heat in the outdoor heat exchanger (22) and evaporates in the refrigeration-facility heat exchanger (83) and the indoor heat exchanger (93).

Specifically, the refrigerant compressed in the first compressor (31) and the second compressor (41) flows through the outdoor heat exchanger (22) via the first flow path (71) of the bridge circuit (70). At the outdoor heat exchanger (22), the heat of the refrigerant is released to the outdoor air. The refrigerant that has radiated heat in the outdoor heat exchanger (22) flows through the refrigeration-facility heat exchanger (83) and the indoor heat exchanger (93) via the receiver (24) and the high pressure-side flow path (25*a*) of the subcooling heat exchanger (25). In the refrigeration-facility heat exchanger (83), the interior air is cooled by the evaporating refrigerant. The refrigerant evaporated in the refrigeration-facility heat exchanger (83) is sucked into the first compressor (31) via the first gas connection pipe (13). The refrigerant evaporated in the indoor heat exchanger (93) is sucked into the second compressor (41) via the fourth flow path (74) of the bridge circuit (70) and the suction relay pipe (58).

<Heating Operation>

Figure 6:
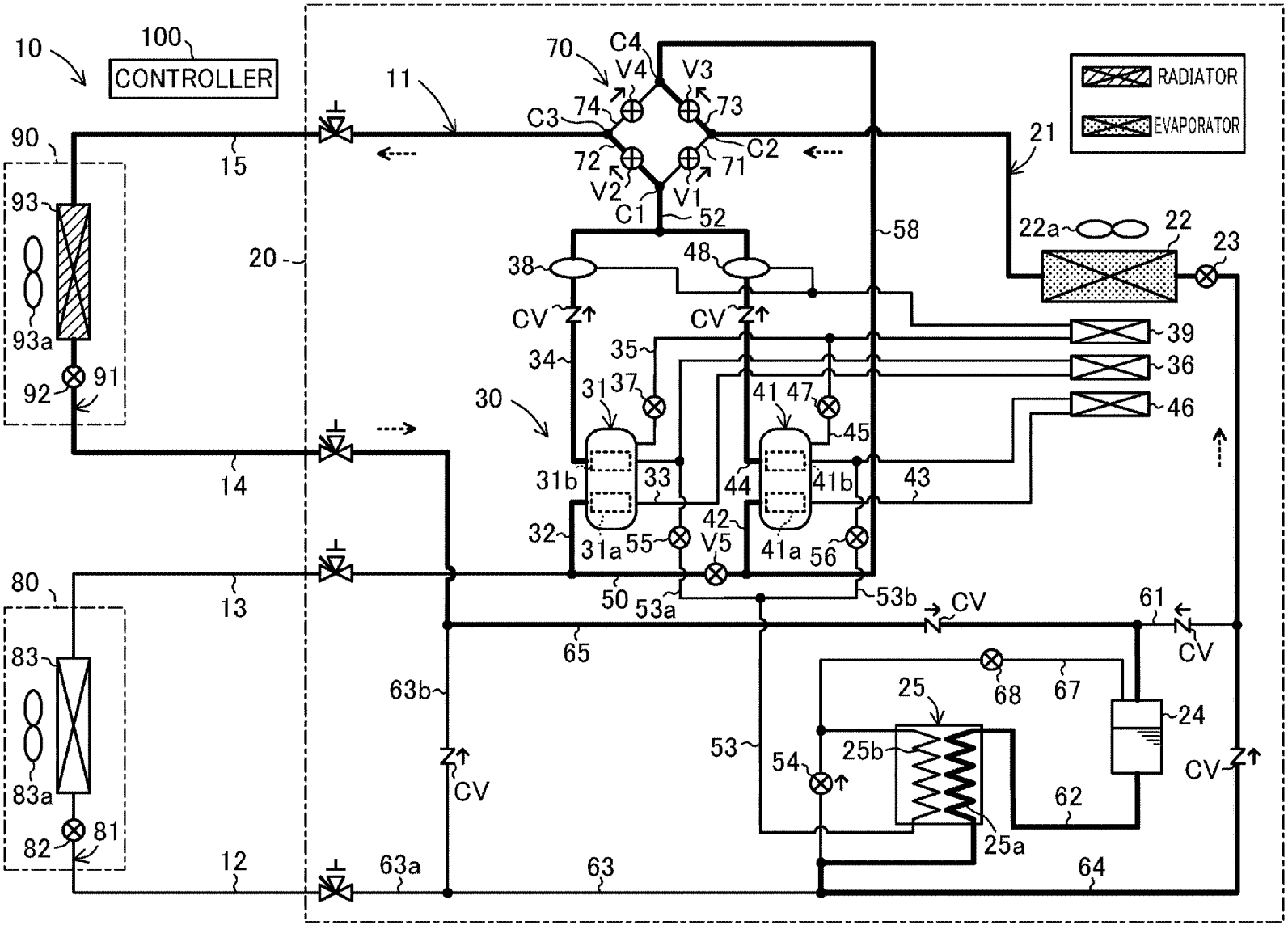
FIG. 6 is a diagram corresponding to FIG. 1, illustrating the flow of refrigerant in a heating operation.

During the heating operation illustrated in FIG. 6, the second valve (V2) and the third valve (V3) are opened, while the first valve (V1) and the fourth valve (V4) are closed. The opening degree of the outdoor expansion valve (23) is adjusted through superheating control, the refrigeration-facility expansion valve (82) is closed, and the indoor expansion valve (92) is fully opened. A refrigeration cycle is performed in which the refrigerant compressed in the compression unit (30) radiates heat in the indoor heat exchanger (93) and evaporates in the outdoor heat exchanger (22).

Specifically, the refrigerant compressed in the first compressor (31) and the second compressor (41) flows through the indoor heat exchanger (93) via the second flow path (72) of the bridge circuit (70) and the second gas connection pipe (15). In the indoor heat exchanger (93), the indoor air is heated by the refrigerant radiating heat. The refrigerant that has radiated heat in the indoor heat exchanger (93) flows through the outdoor heat exchanger (22) via the receiver (24) and the high pressure-side flow path (25*a*) of the subcooling heat exchanger (25). In the outdoor heat exchanger (22), the refrigerant absorbs heat from the indoor air and evaporates. The refrigerant evaporated in the outdoor heat exchanger (22) is sucked into the first compressor (31) and the second compressor (41) via the third flow path (73) of the bridge circuit (70) and the suction relay pipe (58).

<Heating and Refrigeration-Facility Operation>

Figure 7:
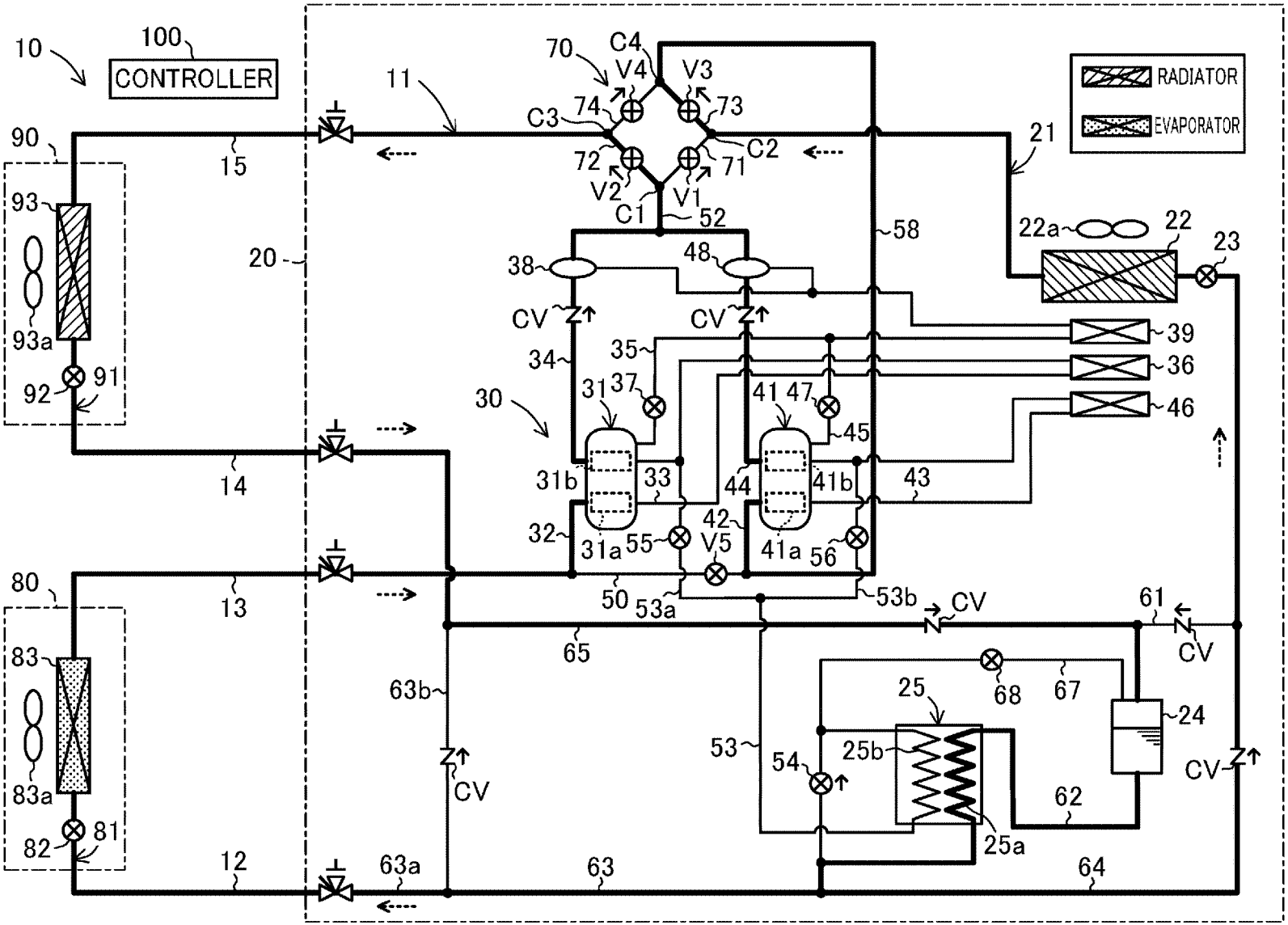
FIG. 7 is a diagram corresponding to FIG. 1, illustrating the flow of refrigerant in a heating and refrigeration-facility operation.

During the heating and refrigeration-facility operation illustrated in FIG. 7, the second valve (V2) and the third valve (V3) are opened, while the first valve (V1) and the fourth valve (V4) are closed. The opening degrees of the outdoor expansion valve (23) and the refrigeration-facility expansion valve (82) are adjusted through superheating control, and the indoor expansion valve (92) is opened. A refrigeration cycle is performed in which the refrigerant compressed in the compression unit (30) radiates heat in the indoor heat exchanger (93) and evaporates in the outdoor heat exchanger (22) and the refrigeration-facility heat exchanger (83).

Specifically, the refrigerant compressed in the first compressor (31) and the second compressor (41) flows through the indoor heat exchanger (93) via the second flow path (72) of the bridge circuit (70) and the second gas connection pipe (15). In the indoor heat exchanger (93), the indoor air is heated by the refrigerant radiating heat. The refrigerant that has radiated heat in the indoor heat exchanger (93) flows through the outdoor heat exchanger (22) and the refrigeration-facility heat exchanger (83) via the receiver (24) and the high pressure-side flow path (25*a*) of the subcooling heat exchanger (25). In the outdoor heat exchanger (22), the refrigerant absorbs heat from the indoor air and evaporates. The refrigerant evaporated in the outdoor heat exchanger (22) is sucked into the second compressor (41) via the third flow path (73) of the bridge circuit (70) and the suction relay pipe (58). In the refrigeration-facility heat exchanger (83), the interior air is cooled by the evaporating refrigerant. The refrigerant evaporated in the refrigeration-facility heat exchanger (83) is sucked into the first compressor (31) via the first gas connection pipe (13).

<Heating and Refrigeration-Facility Heat Recovery Operation>

Figure 8:
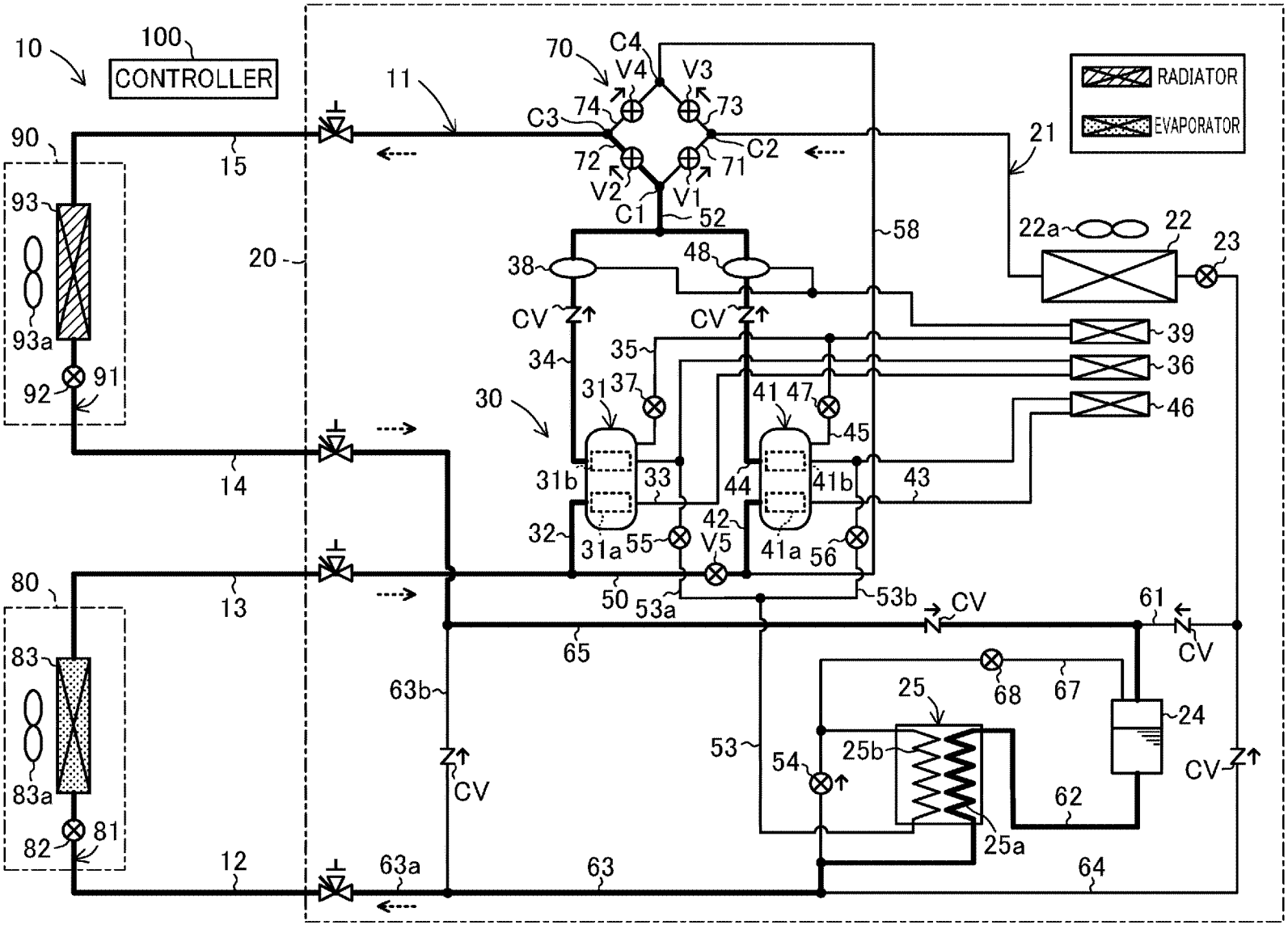
FIG. 8 is a diagram corresponding to FIG. 1, illustrating the flow of refrigerant in a heating and refrigeration-facility heat recovery operation.

During the heating and refrigeration-facility heat recovery operation illustrated in FIG. 8, the second valve (V2) is opened, while the first valve (V1) and the fourth valve (V4)

are closed. The third valve (V3) is basically opened. The outdoor expansion valve (23) is fully closed, the opening degree of the refrigeration-facility expansion valve (82) is adjusted through superheating control, and the indoor expansion valve (92) is fully opened. A refrigeration cycle (first refrigeration cycle) is performed in which the refrigerant compressed in the compression unit (30) radiates heat in the indoor heat exchanger (93) and evaporates in the refrigeration-facility heat exchanger (83). At this time, the outdoor heat exchanger (22) is stopped.

Specifically, the refrigerant compressed in the first compressor (31) and the second compressor (41) flows through the indoor heat exchanger (93) via the second flow path (72) of the bridge circuit (70) and the second gas connection pipe (15). In the indoor heat exchanger (93), the indoor air is heated by the refrigerant radiating heat. The refrigerant that has radiated heat in the indoor heat exchanger (93) flows through the refrigeration-facility heat exchanger (83) via the receiver (24) and the high pressure-side flow path (25*a*) of the subcooling heat exchanger (25). In the refrigeration-facility heat exchanger (83), the interior air is cooled by the evaporating refrigerant. The refrigerant evaporated in the refrigeration-facility heat exchanger (83) is sucked into the first compressor (31) and the second compressor (41) via the first gas connection pipe (13).

<Heating and Refrigeration-Facility Residual Heat Operation>

Figure 9:
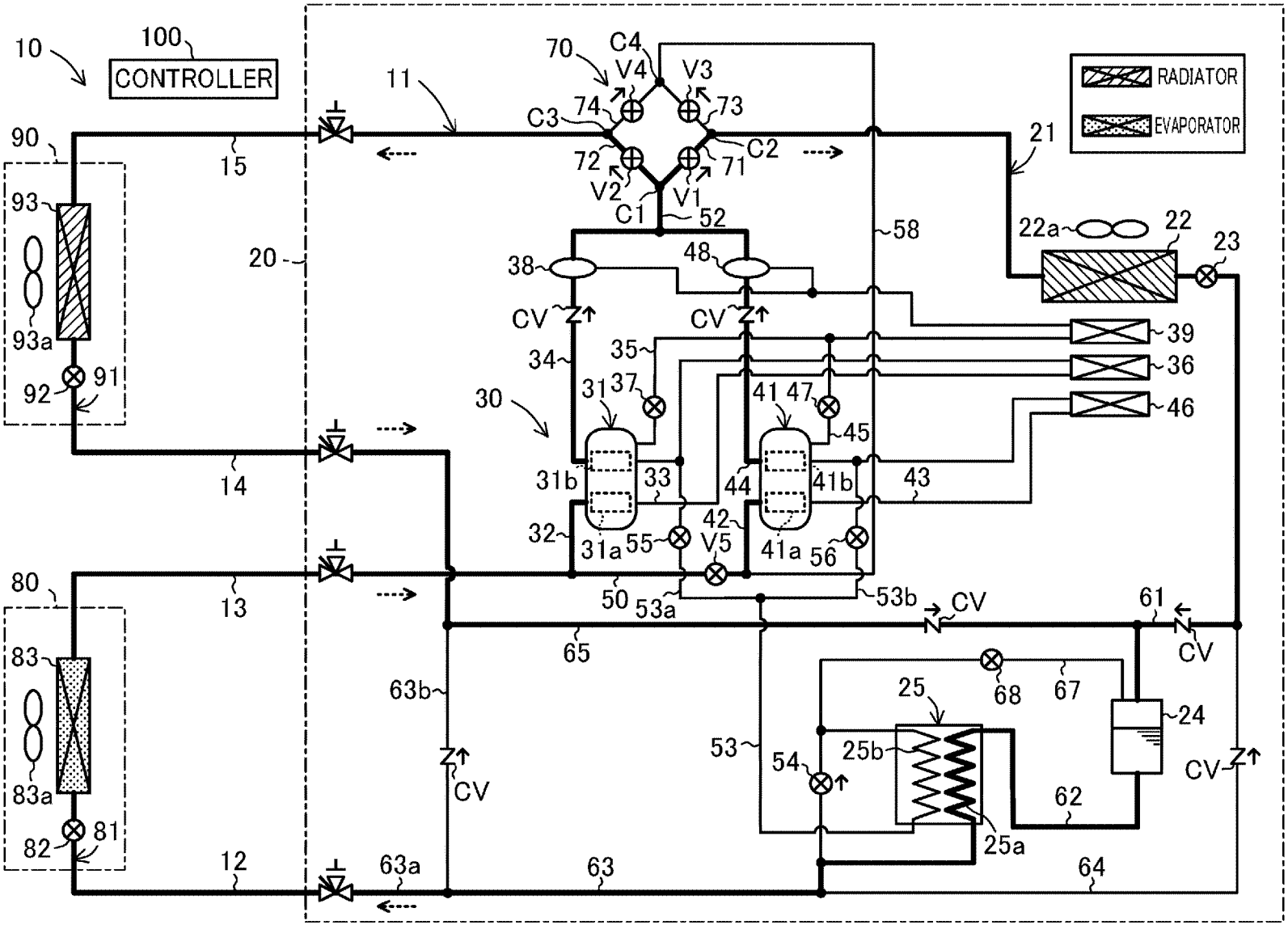
FIG. 9 is a diagram corresponding to FIG. 1, illustrating the flow of refrigerant in a heating and refrigeration-facility residual heat operation.

During the heating and refrigeration-facility residual heat operation illustrated in FIG. 9, the first valve (V1) and the second valve (V2) are opened, while the third valve (V3) and the fourth valve (V4) are closed. The outdoor expansion valve (23) and the indoor expansion valve (92) are fully opened, and the opening degree of the refrigeration-facility expansion valve (82) is adjusted through superheating control. A refrigeration cycle (second refrigeration cycle) is performed in which the refrigerant compressed in the compression unit (30) radiates heat in the outdoor heat exchanger (22) and the indoor heat exchanger (93) and evaporates in the refrigeration-facility heat exchanger (83).

Specifically, the refrigerant compressed in the first compressor (31) and the second compressor (41) is branched off and flows into the first flow path (71) and the second flow path (72) of the bridge circuit (70). The refrigerant that has flowed out of the first flow path (71) flows through the outdoor heat exchanger (22). At the outdoor heat exchanger (22), the heat of the refrigerant is released to the outdoor air. The refrigerant that has flowed out of the second flow path (72) flows through the indoor heat exchanger (93) via the second gas connection pipe (15). In the indoor heat exchanger (93), the indoor air is heated by the refrigerant radiating heat. The refrigerant that has radiated heat in the indoor heat exchanger (93) joins the refrigerant that has radiated heat in the outdoor heat exchanger (22), and flows through the refrigeration-facility heat exchanger (83) via the receiver (24) and the high pressure-side flow path (25*a*) of the subcooling heat exchanger (25). In the refrigeration-facility heat exchanger (83), the interior air is cooled by the evaporating refrigerant. The refrigerant evaporated in the refrigeration-facility heat exchanger (83) is sucked into the first compressor (31) and the second compressor (41) via the first gas connection pipe (13).

<Defrost Operation>

The flow of refrigerant during the defrost operation is similar to that during the cooling operation illustrated in FIG. 3. That is, the refrigerant compressed in the first compressor (31) and the second compressor (41) radiates heat in the outdoor heat exchanger (22). This melts the frost on the surface of the outdoor heat exchanger (22). The refrigerant that has been used for defrosting the outdoor heat exchanger (22) is sucked into the first compressor (31) and the second compressor (41) after evaporating in the indoor heat exchanger (93).

—Control of Third Valve in Heating and Refrigeration-Facility Heat Recovery Operation—

During the heating and refrigeration-facility heat recovery operation described above, the third valve (V3) is controlled in order to prevent the refrigerant on the suction side of the compression unit (30) (first compressor (31) and second compressor (41)) from flowing into the outdoor heat exchanger (22).

The refrigeration device (10) has a sensor for determining Condition A indicating that an internal pressure Po of the outdoor heat exchanger (22) is lower than a suction-side pressure Ps of the compression unit (30). For example, in the example illustrated in FIG. 1, the outdoor air temperature sensor (94) provided in the outdoor unit (20) is used as such a sensor. The outdoor air temperature sensor (94) detects a temperature To of the outdoor air around the outdoor heat exchanger (22).

Figure 10:
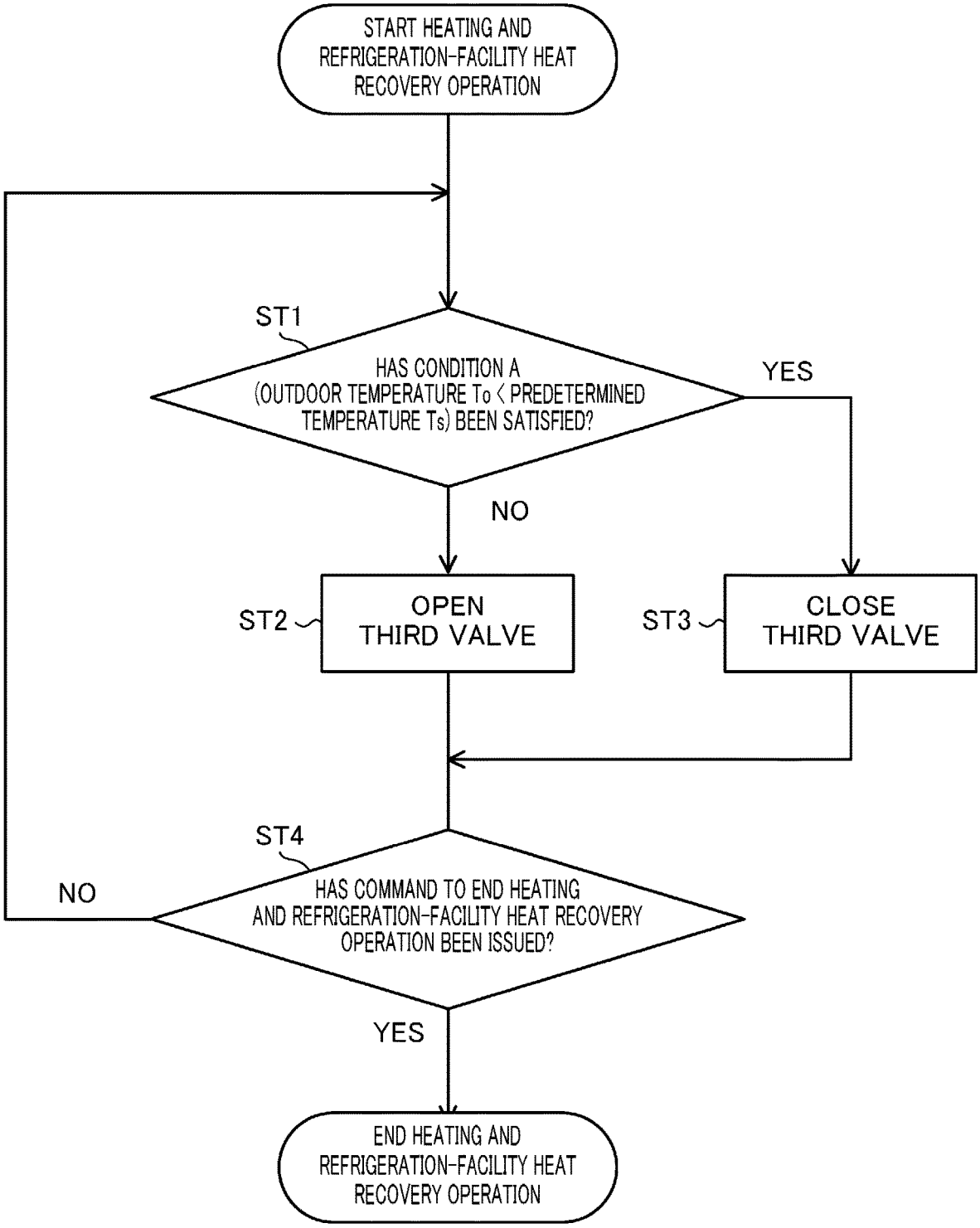
FIG. 10 is a flowchart relating to control of a third valve in the heating and refrigeration-facility heat recovery operation.

As illustrated in FIG. 10, when the heating and refrigeration-facility heat recovery operation is executed, it is determined whether the temperature To detected by the outdoor air temperature sensor (94) is higher than a predetermined temperature Ts (step ST1). Here, the predetermined temperature Ts is a threshold of a temperature condition under which the internal pressure Po of the outdoor heat exchanger (22) can be lower than the suction pressure Ps due to a low outdoor air temperature.

In a case where the detected outdoor air temperature To is equal to or higher than the predetermined temperature Ts in step ST1, the controller (100) opens the third valve (V3) (step ST2). As a result, the refrigerant inside the outdoor heat exchanger (22) is gradually drawn into the suction side of the compression unit (30), and is thus used for the refrigeration cycle.

In a case where the detected outdoor air temperature To is lower than the predetermined temperature Ts in step ST1, the controller (100) closes the third valve (V3) (step ST3). In the case where the outdoor air temperature To is lower than the predetermined temperature Ts, the internal pressure Po of the outdoor heat exchanger (22) may be lower than the suction-side pressure Ps of the compression unit (30), and the refrigerant on the suction side of the compression unit (30) may flow into the outdoor heat exchanger (22). In this case, the capacity of the indoor unit (90) and the refrigeration-facility unit (80) during the heating and refrigeration-facility heat recovery operation may decrease. To address this problem, the third valve (V3) is closed under the condition described above, thereby reliably preventing the refrigerant from flowing into the outdoor heat exchanger (22).

—Switching Control During Heating—

As indicated in FIG. 11, the operation of the refrigeration device (10) is switched among the heating and refrigeration-facility operation, the heating and refrigeration-facility heat recovery operation, and the heating and refrigeration-facility residual heat operation in accordance with the required heating capacity of the indoor unit (90). The control exercised at the time of switching these operations will be described. At the time of switching these operations, the compression unit (30) is continuously operated without being stopped. At the time of switching these operations, the opening degrees of the second valve (V2) and the third valve (V3) of the bridge circuit (70) are appropriately adjusted.

During the operation with the indoor unit (90) functioning as a heater, the required heating capacity of the indoor unit (90) is determined. This heating capacity can be determined based on the values detected by various sensors. For example, in the example illustrated in FIG. 1, the first refrigerant temperature sensor (95) is provided at the gas-side end of the indoor heat exchanger (93). The first refrigerant temperature sensor (95) detects a refrigerant temperature T1 on the inlet side of the indoor heat exchanger (93) functioning as a radiator. The second refrigerant temperature sensor (96) is provided at the liquid-side end of the indoor heat exchanger (93). The second refrigerant temperature sensor (96) detects a refrigerant temperature T2 on the outlet side of the indoor heat exchanger (93) functioning as a radiator. The indoor unit (90) is provided with the indoor air temperature sensor (97) (e.g. a suction temperature sensor) that detects a temperature Tr of the indoor air. The controller (100) determines the heating capacity of the indoor unit (90) based on a difference between an average value Tave of the refrigerant temperatures T1 and T2 and the temperature Tr of the indoor air. This method for calculating the heating capacity is adopted in a case where carbon dioxide flowing through the indoor heat exchanger (93) has a pressure equal to or higher than the critical pressure. For example, in a case where the refrigerant flowing through the indoor heat exchanger (93) has a pressure lower than the critical pressure, the heating capacity of the indoor unit (90) may be determined based on a difference between a condensation temperature of the indoor heat exchanger (93) (e.g. a saturation temperature Ts corresponding to a high pressure) and the temperature Tr of the indoor air. Alternatively, another method may be adopted.

<Switching from Heating and Refrigeration-Facility Operation to Heating and Refrigeration-Facility Heat Recovery Operation>

In a case where the required heating capacity is relatively high, the heating and refrigeration-facility operation is performed in the refrigeration device (10). At this time, in the bridge circuit (70), the first valve (V1) and the fourth valve (V4) are closed, while the second valve (V2) and the third valve (V3) are opened. Here, during the heating and refrigeration-facility operation, as the required heating capacity becomes lower, the opening degree of the third valve (V3) gradually decreases. As a result, the pressure of the outdoor heat exchanger (22) gradually increases, and the amount of heat absorbed from the outdoor air to the refrigerant gradually decreases. As described above, when the heating and refrigeration-facility operation is switched to the heating and refrigeration-facility heat recovery operation, the opening degree of the third valve (V3) gradually decreases. Therefore, even if the compression unit (30) continues to operate, the differential pressure of the refrigerant circuit (11) does not change significantly. This makes it possible to avoid a problem that would be caused by a sharp change in the differential pressure.

<Switching from Heating and Refrigeration-Facility Heat Recovery Operation to Heating and Refrigeration-Facility Residual Heat Operation>

In a case where the required heating capacity is intermediate, the heating and refrigeration-facility heat recovery operation is performed in the refrigeration device (10). At this time, in the bridge circuit (70), the first valve (V1), the third valve (V3), and the fourth valve (V4) are closed, while the second valve (V2) is opened. Here, during the heating and refrigeration-facility heat recovery operation, as the required heating capacity becomes lower, the opening degree of the first valve (V1) gradually increases. As a result, the pressure of the outdoor heat exchanger (22) gradually increases, and the amount of heat released from the refrigerant to the outdoor air gradually increases. As described above, when the heating and refrigeration-facility heat recovery operation is switched to the heating and refrigeration-facility residual heat operation, the opening degree of the first valve (V1) gradually increases. Therefore, even if the compression unit (30) continues to operate, the differential pressure of the refrigerant circuit (11) does not change significantly. This makes it possible to avoid a problem that would be caused by a sharp change in the differential pressure.

<Switching from Heating and Refrigeration-Facility Residual Heat Operation to Heating and Refrigeration-Facility Heat Recovery Operation>

During the heating and refrigeration-facility residual heat operation, as the required heating capacity becomes higher, the opening degree of the first valve (V1) gradually decreases. As a result, the pressure of the outdoor heat exchanger (22) gradually decreases, and the amount of heat released from the refrigerant to the outdoor air gradually decreases. As described above, when the heating and refrigeration-facility residual heat operation is switched to the heating and refrigeration-facility heat recovery operation, the opening degree of the first valve (V1) gradually decreases. Therefore, even if the compression unit (30) continues to operate, the differential pressure of the refrigerant circuit (11) does not change significantly. This makes it possible to avoid a problem that would be caused by a sharp change in the differential pressure.

<Switching from Heating and Refrigeration-Facility Heat Recovery Operation to Heating and Refrigeration-Facility Operation>

During the heating and refrigeration-facility heat recovery operation, as the required heating capacity becomes lower, the opening degree of the third valve (V3) gradually increases. As a result, the pressure of the outdoor heat exchanger (22) gradually decreases, and the amount of heat absorbed from the outdoor air to the refrigerant gradually increases. As described above, when the heating and refrigeration-facility heat recovery operation is switched to the heating and refrigeration-facility operation, the opening degree of the third valve (V3) gradually increases. Therefore, even if the compression unit (30) continues to operate, the differential pressure of the refrigerant circuit (11) does not change significantly. This makes it possible to avoid a problem that would be caused by a sharp change in the differential pressure.

—Defrost Operation Switching Control—

If a command to execute the defrost operation is issued during the heating and refrigeration-facility operation, the heating and refrigeration-facility heat recovery operation, and the heating and refrigeration-facility residual heat operation, any of these operations is switched to the defrost operation as follows.

<Switching Between Heating and Refrigeration-Facility Operation and Defrost Operation>

In a case where a command to start the defrost operation is issued during the heating and refrigeration-facility operation, the compression unit (30) continues to operate as it is, and the operation is switched in the following order: the heating and refrigeration-facility operation, the heating and refrigeration-facility heat recovery operation, and then the defrost operation. As a result, the outdoor heat exchanger (22) that has functioned as the evaporator during the heating and refrigeration-facility operation is stopped during the heating and refrigeration-facility heat recovery operation, and functions as the radiator during the defrost operation. As a result, the pressure fluctuation in the outdoor heat exchanger (22) can be suppressed.

In a case where a command to end the defrost operation is issued thereafter, the compression unit (30) continues to operate as it is, and the operation is switched in the following order: the defrost operation, the heating and refrigeration-facility heat recovery operation, and then the heating and refrigeration-facility operation. As a result, the outdoor heat exchanger (22) that has functioned as the radiator during the defrost operation is stopped during the heating and refrigeration-facility heat recovery operation, and functions as the evaporator during the heating and refrigeration-facility operation. As a result, the pressure fluctuation in the outdoor heat exchanger (22) can be suppressed. Note that, at the time of switching between these operations, it is possible to gradually change the opening degrees of the second valve (V2) and the third valve (V3) as illustrated in FIG. 11.

<Switching Between Heating and Refrigeration-Facility Heat Recovery Operation and Defrost Operation>

In a case where the command to start the defrost operation is issued during the heating and refrigeration-facility heat recovery operation, the compression unit (30) continues to operate as it is, and the operation is switched in the following order: the heating and refrigeration-facility heat recovery operation and then the defrost operation. In a case where the command to end the defrost operation is issued thereafter, the compression unit (30) continues to operate as it is, and the operation is switched in the following order: the defrost operation and then the heating and refrigeration-facility heat recovery operation.

<Switching Between Heating and Refrigeration-Facility Residual Heat Operation and Defrost Operation>

In a case where the command to start the defrost operation is issued during the heating and refrigeration-facility residual heat operation, the compression unit (30) continues to operate as it is, and the operation is switched in the following order: the heating and refrigeration-facility residual heat operation and then the defrost operation. In a case where the command to end the defrost operation is issued thereafter, the compression unit (30) continues to operate as it is, and the operation is switched in the following order: the defrost operation and then the heating and refrigeration-facility residual heat operation.

—Switching Control Between Cooling Operation and Heating Operation—

If a command to switch the cooling operation to the heating operation is issued, control is exercised to switch the valves (V1, V2, V3, V4) of the bridge circuit (70) after stopping the compression unit (30). Specifically, in the bridge circuit (70), the closed second valve (V2) and third valve (V3) are opened, while the opened first valve (V1) and fourth valve (V4) are closed. The compression unit (30) is then operated, whereby the heating operation is performed.

If a command to switch the heating operation to the cooling operation is issued, control is exercised to switch the valves (V1, V2, V3, V4) of the bridge circuit (70) after stopping the compression unit (30). Specifically, in the bridge circuit (70), the opened second valve (V2) and third valve (V3) are closed, while the closed first valve (V1) and fourth valve (V4) are opened. The compression unit (30) is then operated, whereby the cooling operation is performed.

Effects of Embodiment

In the above embodiment, the flow path switching mechanism includes the first to fourth flow paths (71, 72, 73, 74) and the opening and closing mechanisms (four valves (V1, V2, V3, V4)) that open and close the respective flow paths (71, 72, 73, 74). The first connection point (C1) connecting the inflow portion of the first flow path (71) and the inflow portion of the second flow path (72) is connected to the discharge portion of the compression unit (30). The second connection point (C2) connecting the outflow portion of the first flow path (71) and the inflow portion of the third flow path (73) is connected to the gas-side end of the outdoor heat exchanger (22). The third connection point (C3) connecting the outflow portion of the second flow path (72) and the inflow portion of the fourth flow path (74) is connected to the gas-side end of the second utilization heat exchanger (93). The fourth connection point (C4) connecting the outflow portion of the third flow path (73) and the outflow portion of the fourth flow path (74), and the gas-side end of the refrigeration-facility heat exchanger (83) are connected to the suction portion of the compression unit (30).

With this configuration, as illustrated in FIG. 2, opening or closing the respective valves (V1, V2, V3, V4) of the bridge circuit (70) enables at least the cooling and refrigeration-facility operation, the heating and refrigeration-facility operation, the heating and refrigeration-facility heat recovery operation, and the heating and refrigeration-facility residual heat operation, and additionally enables the refrigeration-facility operation, the cooling operation, the defrost operation, and the heating operation.

In a case of switching the flow path with a four-way switching valve, a spool is driven by the differential pressure. As a result, noise may occur due to the impact on the spool, and a pipe may be broken or damaged due to vibration. In particular, in a case where carbon dioxide is used as the refrigerant, the differential pressure reaches about 10 MPa, making the above problems noticeable. In the present embodiment, on the other hand, the valves (V1, V2, V3, V4) of the bridge circuit (70) are driven by the motor or electromagnetic force, making it possible to avoid the problems that would be caused by the differential pressure.

In the case of switching the flow path with a four-way switching valve, it is necessary to make high-pressure refrigerant and low-pressure refrigerant act on the four-way switching valve through the pipe. Meanwhile, when the above-mentioned operations are switched in the refrigeration device, a high-pressure line and a low-pressure line change appropriately. Therefore, the circuit configuration needs to be complicated in order for the high-pressure refrigerant and the low-pressure refrigerant to act on the four-way switching valve during all the operations. In the present embodiment, on the other hand, the valves (V1, V2, V3, V4) can be driven regardless of the change in the high-pressure line and the low-pressure line, and thus the circuit configuration can be simplified.

In the present embodiment, all of the four valves (V1, V2, V3, V4) are flow rate adjustment valves having an adjustable opening degree. This makes it possible to adjust the flow rate of the refrigerant flowing in each of the flow paths (71, 72, 73, 74) of the bridge circuit (70).

In particular, with the first valve (V1) as a flow rate adjustment valve, it is possible to adjust the opening degree of the flow path between the discharge portion of the compression unit (30) and the gas-side end of the outdoor heat exchanger (22). As a result, as illustrated in FIG. 11, it is possible to gradually change the pressure of the refrigerant in the outdoor heat exchanger (22) functioning as a radiator, and a sharp change in the differential pressure can be suppressed. It is also possible to adjust the amount of heat released from the refrigerant in the outdoor heat exchanger (22).

In particular, with the third valve (V3) as a flow rate adjustment valve, it is possible to adjust the opening degree of the flow path between the suction portion of the compression unit (30) and the gas-side end of the outdoor heat exchanger (22). As a result, as illustrated in FIG. 11, it is possible to gradually change the pressure of the refrigerant in the outdoor heat exchanger (22) functioning as an evaporator, and a sharp change in the differential pressure can be suppressed. It is also possible to adjust the amount of heat absorbed by the refrigerant in the outdoor heat exchanger (22).

In the above embodiment, the valve (V3) of the third flow path (73) is closed during the refrigeration cycle (heating and refrigeration-facility heat recovery operation) in which the indoor heat exchanger (93) functions as a radiator, the refrigeration-facility heat exchanger (83) functions as an evaporator, and the outdoor heat exchanger (85) is stopped.

Specifically, as illustrated in FIG. 10, when the outdoor air temperature To is lower than the predetermined temperature Ts, the controller (100) closes the third valve (V3). This can reliably prevent the refrigerant on the suction side of the compression unit (30) from flowing into the outdoor heat exchanger (22), which would otherwise be caused by the decrease in the temperature and pressure of the refrigerant inside the outdoor heat exchanger (22). Therefore, it is possible to suppress a decrease in the capacity of the heating and refrigeration-facility heat recovery operation.

When the outdoor air temperature To is higher than the predetermined temperature Ts, on the other hand, the controller (100) opens the third valve (V3). Therefore, the refrigerant inside the outdoor heat exchanger (22) can be drawn toward the compression unit (30), and the capacity of the heating and refrigeration-facility heat recovery operation can be sufficiently ensured.

In the embodiment, the compression unit (30) includes the first compressor (31) and the second compressor (41), the suction portion of the first compressor (31) is connected to the gas-side end of the first utilization heat exchanger (83), and the suction portion of the second compressor (41) is connected to the gas-side end of the second utilization heat exchanger (93) via the fourth flow path (74). Therefore, for example, during the cooling and refrigeration-facility operation, the refrigeration cycle can be performed with the evaporation pressure of the first utilization heat exchanger (83) being different from the evaporation pressure of the second utilization heat exchanger (93).

In the embodiment, carbon dioxide is used as the refrigerant. This may mitigate the effect of global warming.

First Modification of Embodiment

In a refrigeration device (10) of a first modification, an opening and closing mechanism includes two three-way valves (75, 76). The first three-way valve (75) and the second three-way valve (76) are connected to a bridge circuit (70). The first three-way valve (75) is connected to a second connection point (C2) of the bridge circuit (70). The second three-way valve (76) is connected to a third connection point (C3) of the bridge circuit (70). The first three-way valve (75) and the second three-way valve (76) are rotary three-way valves that are driven by a motor.

The first three-way valve (75) is switched between a first state and a second state. The first three-way valve (75) in the first state allows the second connection point (C2) to communicate with a first connection point (C1) and closes off the second connection point (C2) from a fourth connection point (C4). The first three-way valve (75) in the second state allows the second connection point (C2) to communicate with the fourth connection point (C4) and closes off the second connection point (C2) from the first connection point (C1).

The second three-way valve (76) is switched between a first state and a second state. The second three-way valve (76) in the first state allows the third connection point (C3) to communicate with the fourth connection point (C4) and closes off the third connection point (C3) from the first connection point (C1). The second three-way valve (76) in the second state allows the third connection point (C3) to communicate with the first connection point (C1) and closes off the third connection point (C3) from the fourth connection point (C4).

The other configurations of the refrigerant circuit are basically similar to those in the embodiment.

—Operation—

The operation of the refrigeration device (10) of the first modification will be described. The operation of the refrigeration device (10) of the first modification includes, as in the above embodiment, a refrigeration-facility operation, a cooling operation, a cooling and refrigeration-facility operation, a heating operation, a heating and refrigeration-facility operation, a heating and refrigeration-facility heat recovery operation, a heating and refrigeration-facility residual heat operation, and a defrost operation.

<Refrigeration-Facility Operation>

Figure 12:
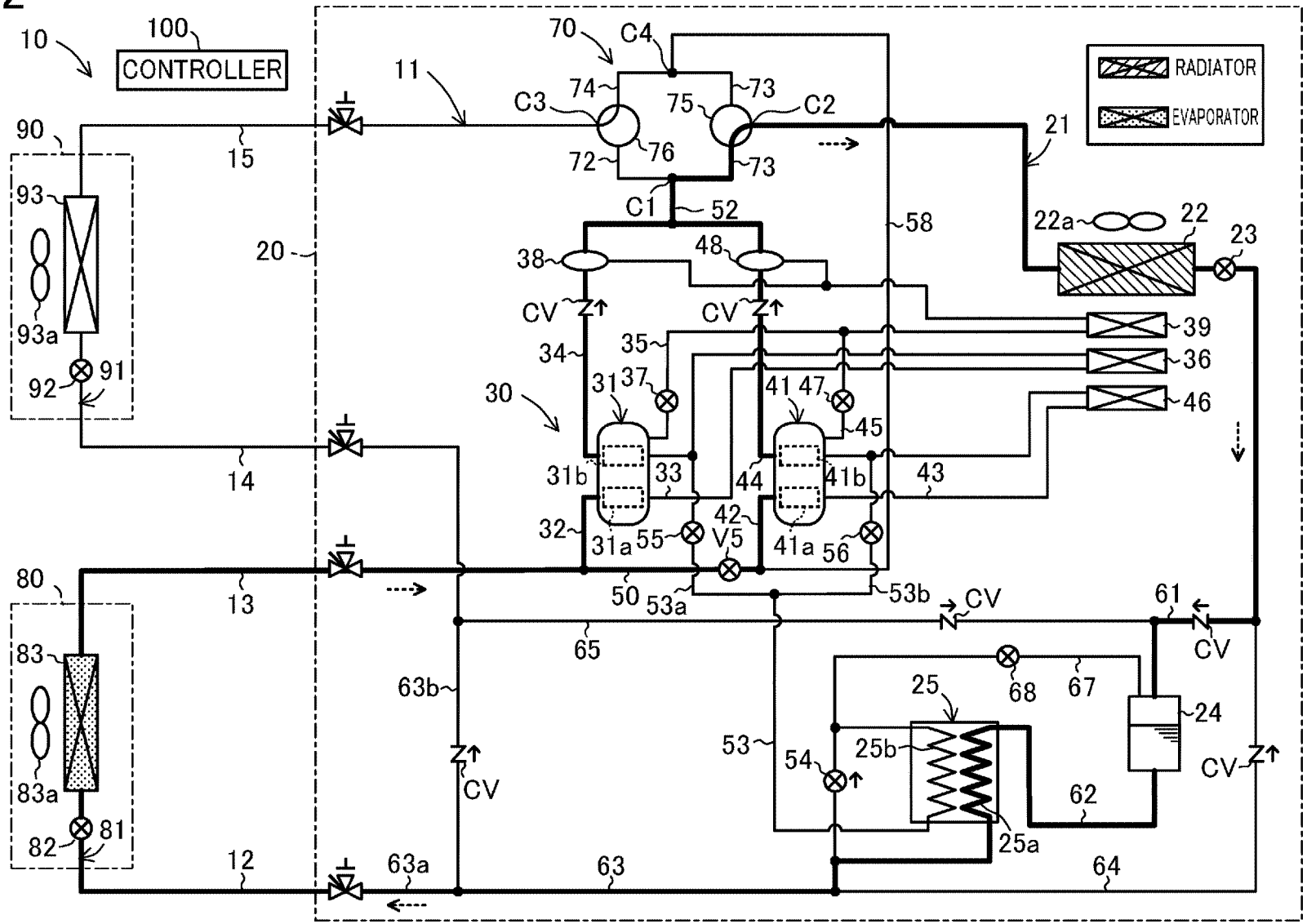
FIG. 12 is a piping system diagram of a refrigeration device according to a first modification, illustrating the flow of refrigerant in a refrigeration-facility operation.

During the refrigeration-facility operation illustrated in FIG. 12, the first three-way valve (75) is in the first state and the second three-way valve (76) is in the first state. An outdoor expansion valve (23) is fully opened, the opening degree of a refrigeration-facility expansion valve (82) is adjusted through superheating control, and an indoor expansion valve (92) is fully closed. A refrigeration cycle is performed in which the refrigerant compressed in a compression unit (30) radiates heat in an outdoor heat exchanger (22) and evaporates in a refrigeration-facility heat exchanger (83). The detailed operation of the refrigeration-facility operation of the first modification is similar to that of the refrigeration-facility operation of the above embodiment.

<Cooling Operation (Defrost Operation)>

Figure 13:
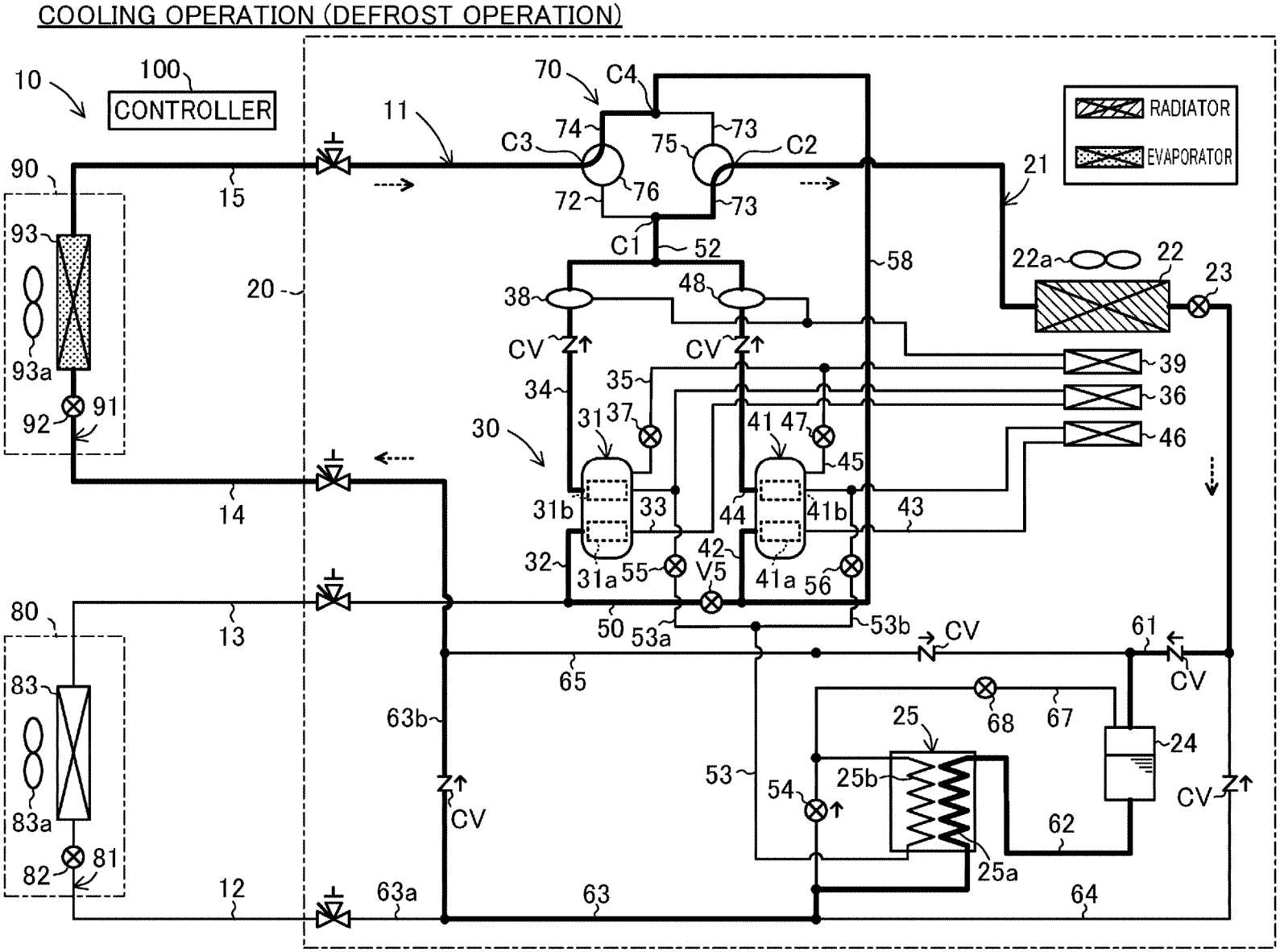
FIG. 13 is a piping system diagram of the refrigeration device according to the first modification, illustrating the flow of refrigerant in a cooling operation.

During the cooling operation illustrated in FIG. 13, the first three-way valve (75) is in the first state and the second three-way valve (76) is in the first state. The outdoor expansion valve (23) is opened, the refrigeration-facility expansion valve (82) is fully closed, and the opening degree of the indoor expansion valve (92) is controlled through superheating control. A refrigeration cycle is performed in which the refrigerant compressed in the compression unit (30) radiates heat in the outdoor heat exchanger (22) and evaporates in the refrigeration-facility heat exchanger (83). The detailed operation of the cooling operation of the first modification is similar to that of the cooling operation of the above embodiment. The flow of refrigerant during the defrost operation of the first modification is similar to that during the cooling operation in FIG. 13.

<Cooling and Refrigeration-Facility Operation>

Figure 14:
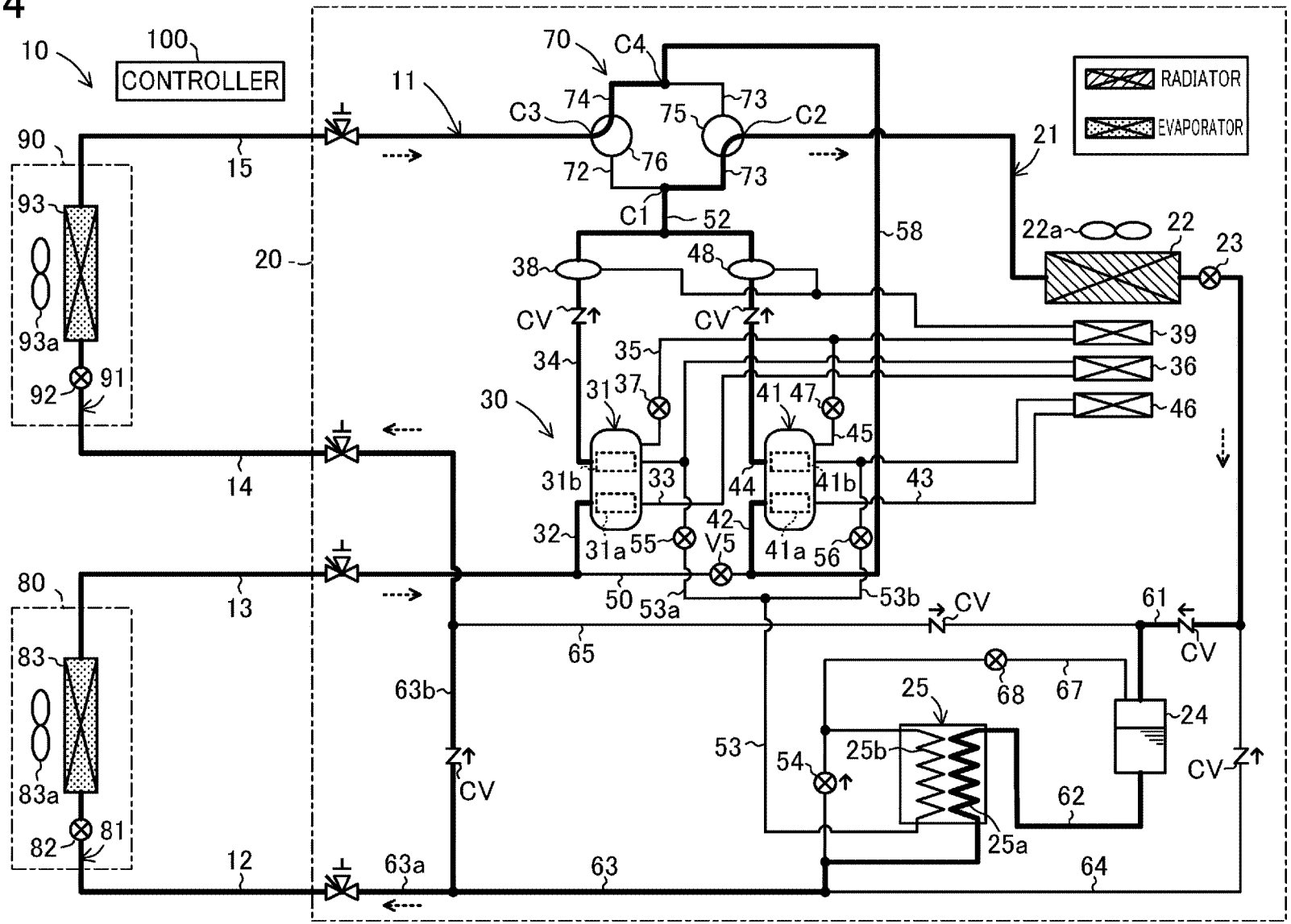
FIG. 14 is a piping system diagram of the refrigeration device according to the first modification, illustrating the flow of refrigerant in a cooling and refrigeration-facility operation.

During the cooling and refrigeration-facility operation illustrated in FIG. 14, the first three-way valve (75) is in the first state and the second three-way valve (76) is in the first state. The outdoor expansion valve (23) is fully opened, and the opening degrees of the refrigeration-facility expansion valve (82) and the indoor expansion valve (92) are controlled through superheating control. A refrigeration cycle is performed in which the refrigerant compressed in the compression unit (30) radiates heat in the outdoor heat exchanger (22) and evaporates in the refrigeration-facility heat exchanger (83) and the indoor heat exchanger (93). The detailed operation of the cooling and refrigeration-facility operation of the first modification is similar to that of the cooling and refrigeration-facility operation of the above embodiment.

<Heating Operation>

Figure 15:
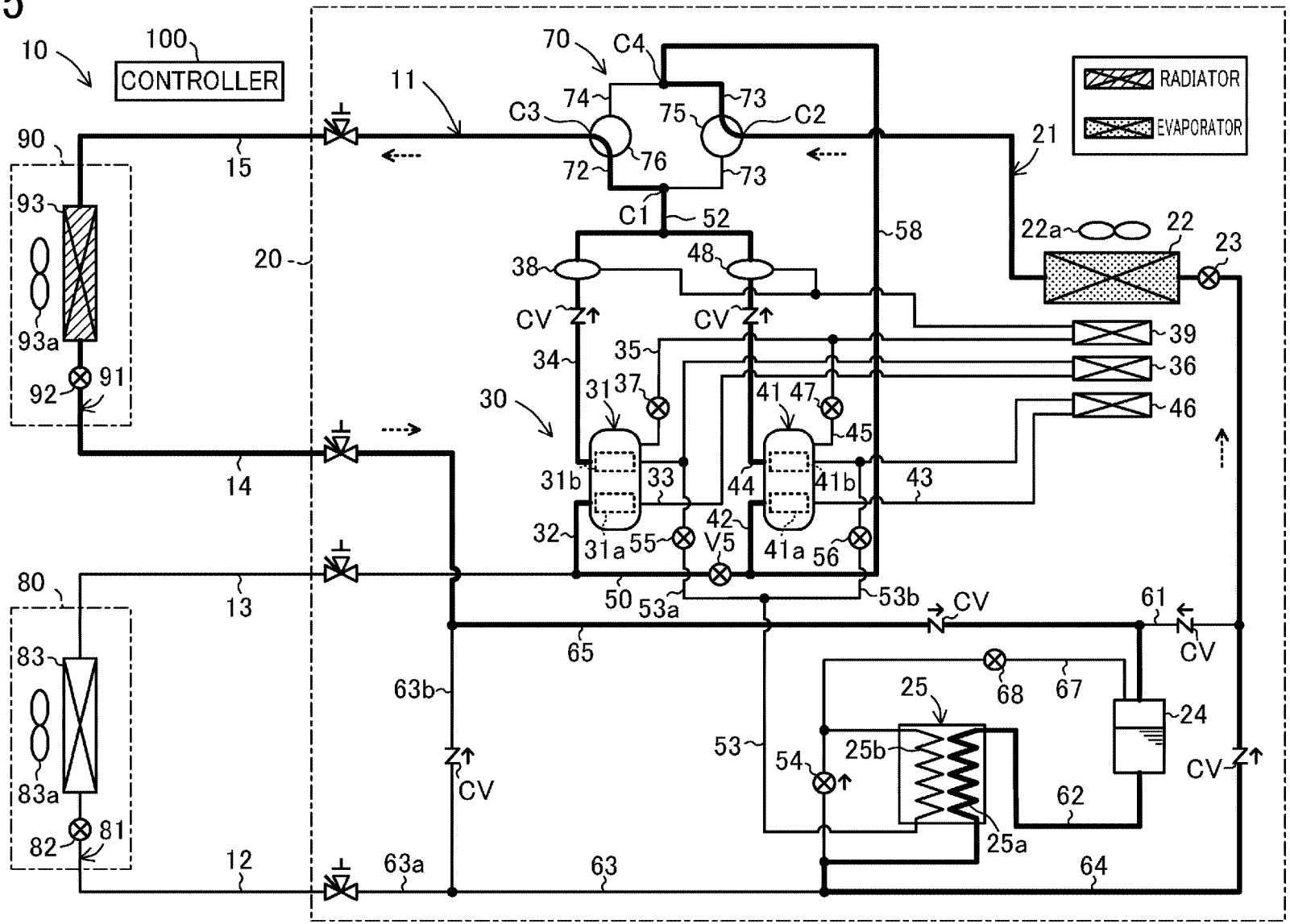
FIG. 15 is a piping system diagram of the refrigeration device according to the first modification, illustrating the flow of refrigerant in a heating operation.

During the heating operation illustrated in FIG. 15, the first three-way valve (75) is in the second state and the second three-way valve (76) is in the second state. The opening degree of the outdoor expansion valve (23) is adjusted through superheating control, the refrigeration-facility expansion valve (82) is fully closed, and the indoor expansion valve (92) is opened. A refrigeration cycle is performed in which the refrigerant compressed in the compression unit (30) radiates heat in the indoor heat exchanger (93) and evaporates in the outdoor heat exchanger (22). The detailed operation of the heating operation of the first modification is similar to that of the heating operation of the above embodiment.

<Heating and Refrigeration-Facility Operation>

Figure 16:
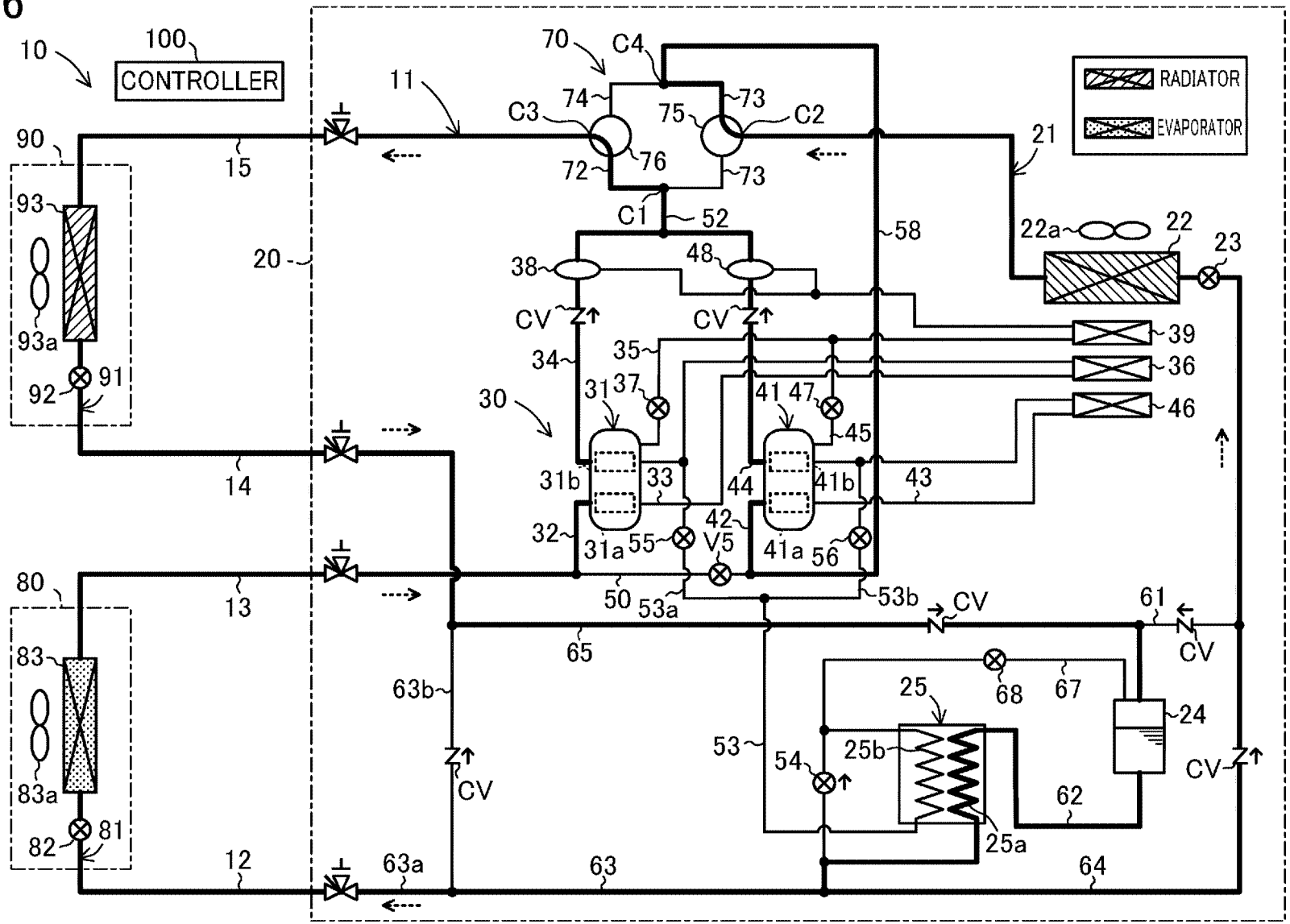
FIG. 16 is a piping system diagram of the refrigeration device according to the first modification, illustrating the flow of refrigerant in a heating and refrigeration-facility operation.

During the heating and refrigeration-facility operation illustrated in FIG. 16, the first three-way valve (75) is in the second state and the second three-way valve (76) is in the second state. The opening degrees of the outdoor expansion valve (23) and the refrigeration-facility expansion valve (82) are adjusted through superheating control, and the indoor expansion valve (92) is opened. A refrigeration cycle is performed in which the refrigerant compressed in the compression unit (30) radiates heat in the indoor heat exchanger (93) and evaporates in the outdoor heat exchanger (22) and the refrigeration-facility heat exchanger (83). The detailed operation of the heating and refrigeration-facility operation of the first modification is similar to that of the heating and refrigeration-facility operation of the above embodiment.

<Heating and Refrigeration-Facility Heat Recovery Operation>

Figure 17:
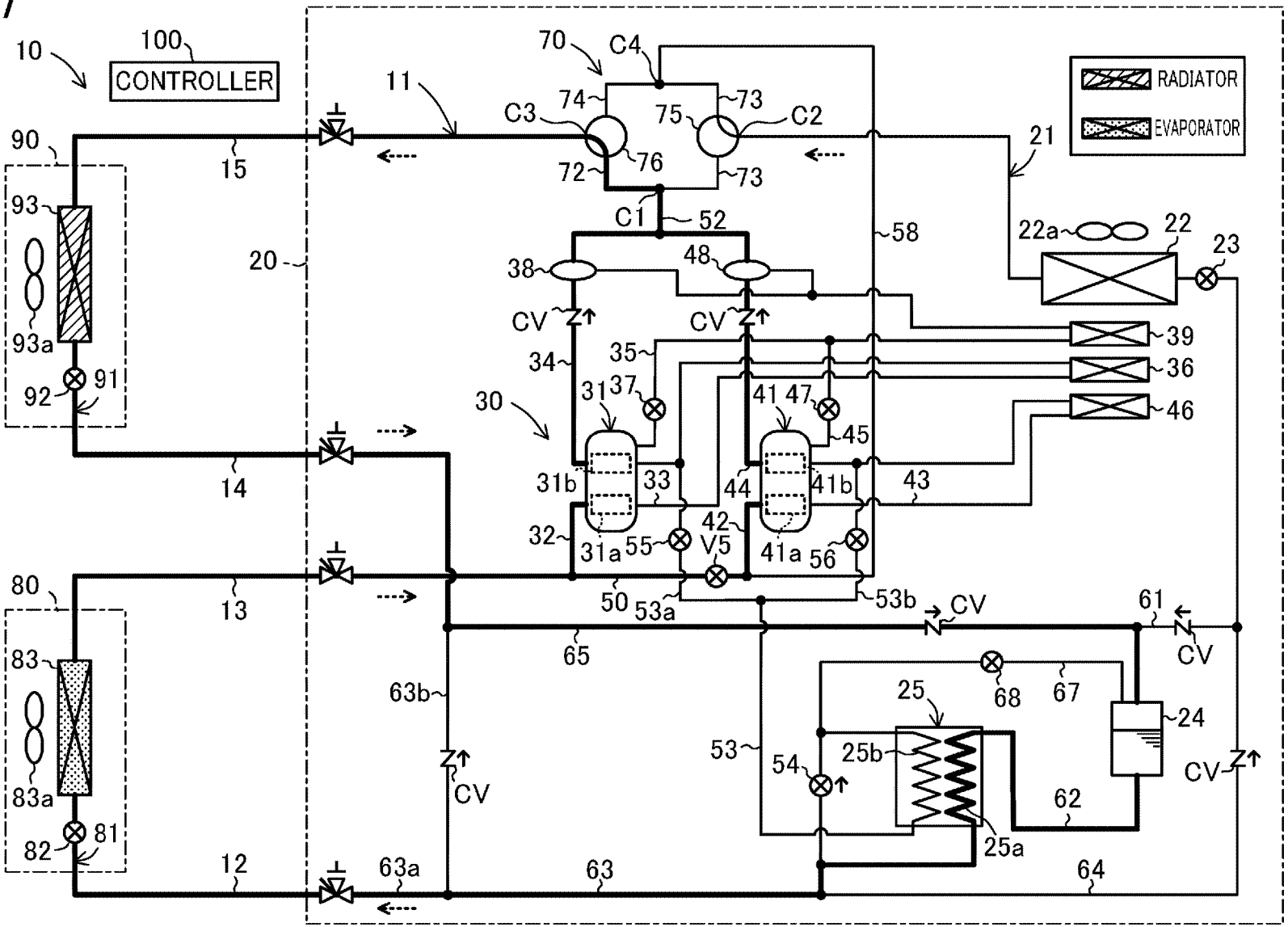
FIG. 17 is a piping system diagram of the refrigeration device according to the first modification, illustrating the flow of refrigerant in a heating and refrigeration-facility heat recovery operation.

During the heating and refrigeration-facility heat recovery operation illustrated in FIG. 17, the first three-way valve (75) is in the second state and the second three-way valve (76) is in the second state. The outdoor expansion valve (23) is fully closed, the opening degree of the refrigeration-facility expansion valve (82) is adjusted through superheating control, and the indoor expansion valve (92) is fully opened. A refrigeration cycle (first refrigeration cycle) is performed in which the refrigerant compressed in the compression unit (30) radiates heat in the indoor heat exchanger (93) and evaporates in the refrigeration-facility heat exchanger (83). At this time, the outdoor heat exchanger (22) is stopped. The detailed operation of the heating and refrigeration-facility heat recovery operation of the first modification is similar to that of the heating and refrigeration-facility heat recovery operation of the above embodiment.

<Heating and Refrigeration-Facility Residual Heat Operation>

Figure 18:
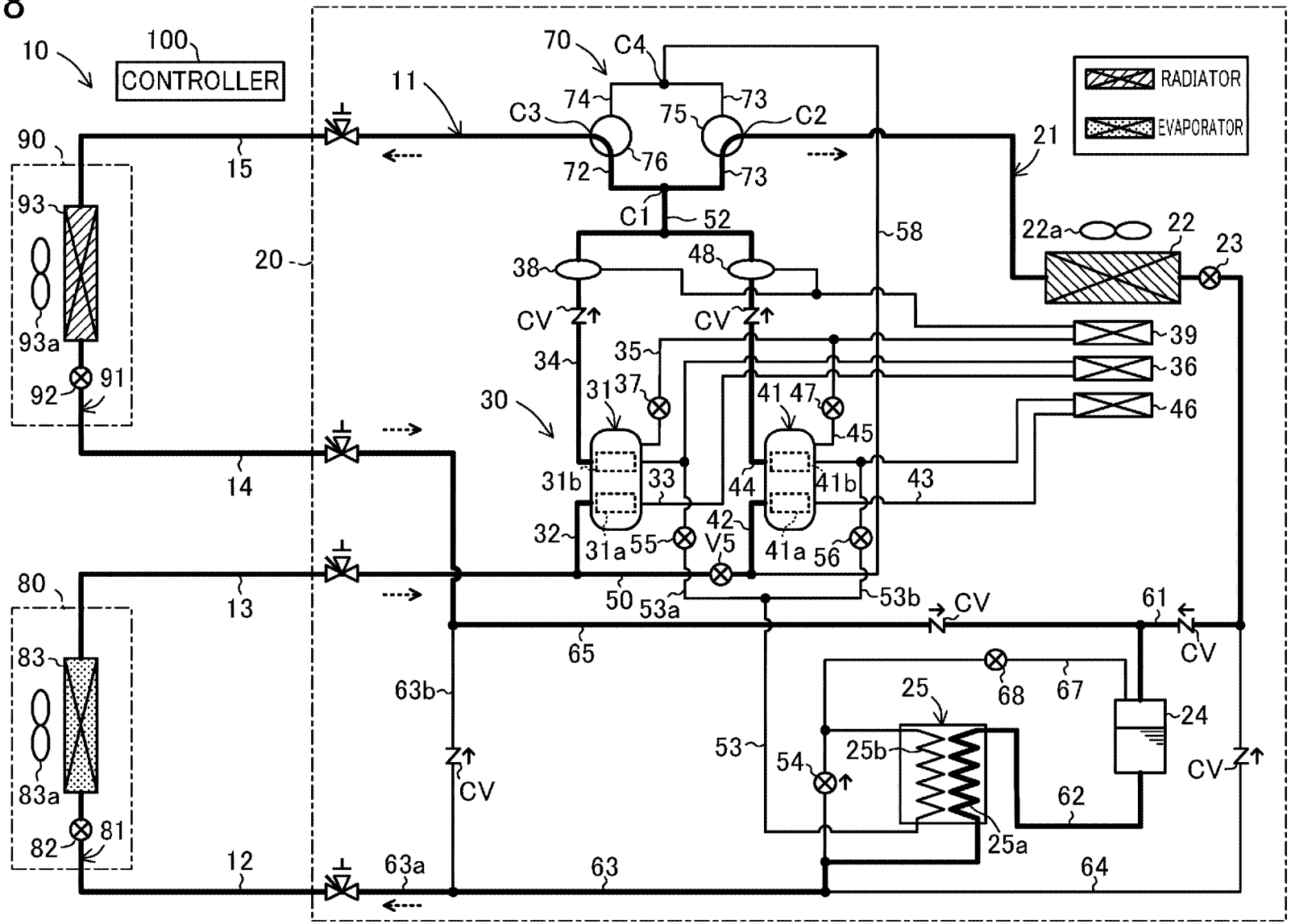
FIG. 18 is a piping system diagram of the refrigeration device according to the first modification, illustrating the flow of refrigerant in a heating and refrigeration-facility residual heat operation.

During the heating and refrigeration-facility residual heat operation illustrated in FIG. 18, the first three-way valve (75) is in the first state and the second three-way valve (76) is in the second state. The outdoor expansion valve (23) and the indoor expansion valve (92) are opened, and the opening degree of the refrigeration-facility expansion valve (82) is adjusted through superheating control. A refrigeration cycle (second refrigeration cycle) is performed in which the refrigerant compressed in the compression unit (30) radiates heat in the outdoor heat exchanger (22) and the indoor heat exchanger (93) and evaporates in the refrigeration-facility heat exchanger (83). The detailed operation of the heating and refrigeration-facility residual heat operation of the first modification is similar to that of the heating and refrigeration-facility residual heat operation of the above embodiment.

Second Modification of Embodiment

Figure 19:
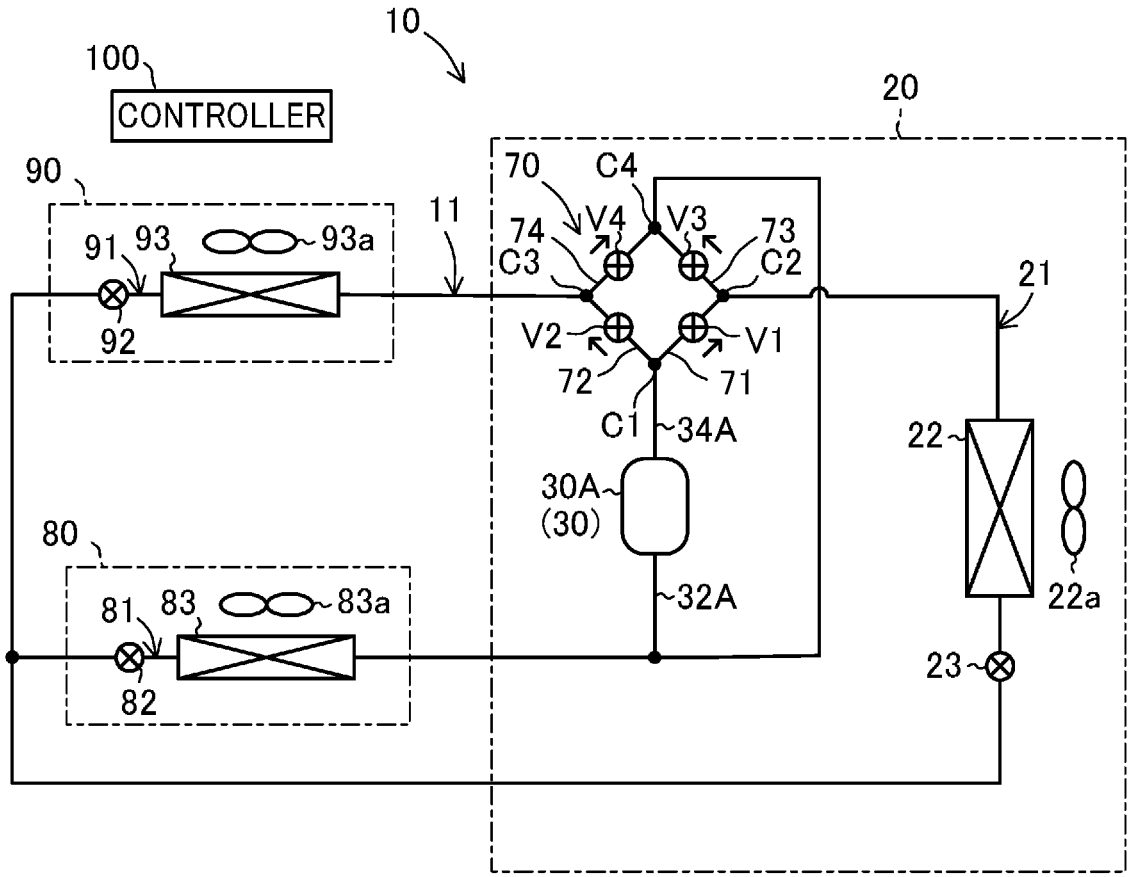
FIG. 19 is a piping system diagram of a refrigeration device according to a second modification.

In a refrigeration device (10) of a second modification, a compression unit (30) includes one compressor (30A). As illustrated in FIG. 19, a bridge circuit (70) is connected to a refrigerant circuit (11) of the refrigeration device (10) of the second modification as in the above embodiment. A first connection point (C1) of the bridge circuit (70) is connected to a discharge portion (discharge pipe (34A)) of the compressor (30A). A second connection point (C2) of the bridge circuit (70) is connected to a gas-side end of an outdoor heat exchanger (22) (heat source heat exchanger). A third connection point (C3) of the bridge circuit (70) is connected to a gas-side end of an indoor heat exchanger (93) (second utilization heat exchanger). A fourth connection point (C4) of the bridge circuit (70) is connected to a suction portion (suction pipe (32A)) of the compressor (30A). In the refrigerant circuit (11) of the modification, a refrigeration-facility heat exchanger (83) and the indoor heat exchanger (93) are connected in parallel to the outdoor heat exchanger (22) as in the above embodiment. A gas-side end of the refrigeration-facility heat exchanger (83) is connected to the suction pipe (32A) of the compressor (30A).

Also in the second modification, a refrigeration-facility operation, a cooling operation, a cooling and refrigeration-facility operation, a heating operation, a heating and refrigeration-facility operation, a heating and refrigeration-facility heat recovery operation, a heating and refrigeration-facility residual heat operation, and a defrost operation are performed while being switched, based on control similar to that in the above embodiment.

During the cooling and refrigeration-facility operation of the second modification, a fourth valve (V4) functions as a pressure adjustment valve or a decompressing valve. That is, it is possible to decompress the refrigerant evaporated in the indoor heat exchanger (93) by adjusting the opening degree of the fourth valve (V4) to a predetermined opening degree smaller than the maximum opening degree. In this manner, the evaporation pressure of the indoor heat exchanger (93) can be maintained higher than the evaporation pressure of the refrigeration-facility heat exchanger (83), and a refrigeration cycle of a so-called different-temperature evaporation type can be implemented.

In the second modification, for example, an opening and closing mechanism may include a first three-way valve (75) and a second three-way valve (76).

Other Embodiments

In the above embodiment and modifications, for example, the following configurations may be adopted.

Figure 20:
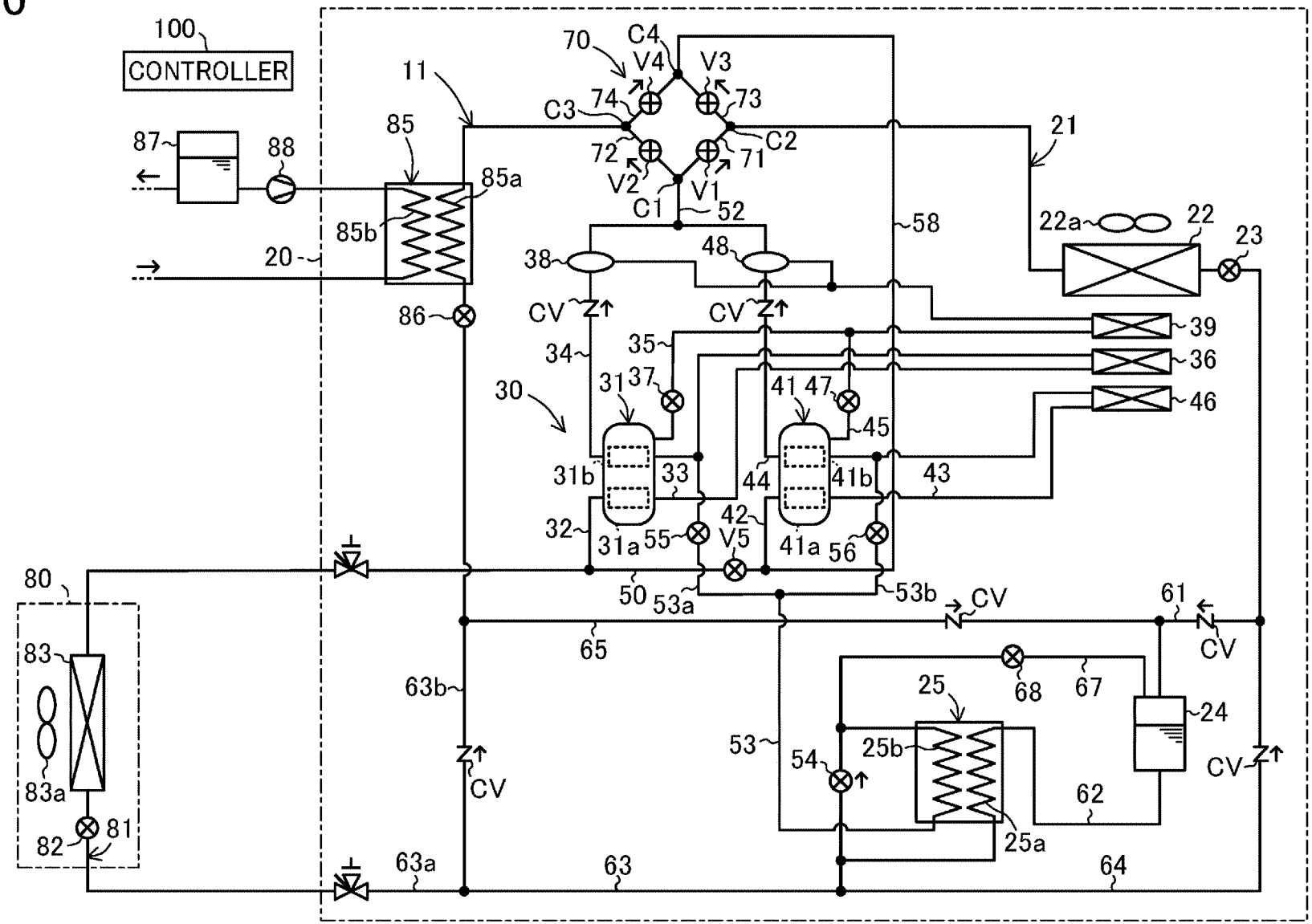
FIG. 20 is a piping system diagram of a refrigeration device according to another embodiment.

For example, the refrigeration device (10) may use, as the second utilization heat exchanger, a heat exchanger (85) that exchanges heat between refrigerant and a heat medium such as water. In a refrigeration device (10) of the example illustrated in FIG. 20, a heat exchanger (85) for generating hot water and cold water is provided instead of the indoor heat exchanger (93) of the embodiment. The heat exchanger (85) is connected to an outdoor circuit (21). An expansion valve (86) that functions similarly to the indoor expansion valve (92) of the embodiment is connected to a liquid side of the heat exchanger (85). The heat exchanger (85) includes a refrigerant flow path (85*a*) and a heat medium flow path (85*b*). In the heat exchanger (85), the refrigerant and the heat medium (water) exchange heat with each other. When the heat exchanger (85) functions as a radiator, the refrigerant in the refrigerant flow path (85*a*) heats the water in the heat medium flow path (85*b*). The water is stored in a tank (87) as hot water. When the heat exchanger (85) functions as an evaporator, the refrigerant in the refrigerant flow path (85*a*) cools the water in the heat medium flow path (85*b*). The water is stored in the tank (87) as cold water. The hot water and cold water stored in the tank (87) are supplied to the target by a pump (88).

For example, the opening and closing mechanisms may be other valves such as an electromagnetic opening and closing valve, as long as the valves can open and close the first to fourth flow paths (71, 72, 73, 74). For example, the opening and closing mechanisms (V1, V2, V3, V4, 75, 76) may be a combination of the valves (V1, V2, V3, V4) of the above embodiment and the three-way valves (75, 76) of the first modification. For example, the first valve (V1) and the third valve (V3) of the above embodiment and the second three-way valve (76) of the first modification may be combined. Alternatively, the second valve (V2) and the fourth valve (V4) of the above embodiment and the first three-way valve (75) may be combined.

The refrigerant in the refrigerant circuit (11) is not limited to carbon dioxide, but may be other refrigerant such as HFC-based refrigerant, for example. For example, the refrigeration cycle may be a so-called critical cycle in which the refrigerant is compressed to a critical pressure or higher, or a so-called subcritical cycle in which the refrigerant is compressed to a pressure lower than the critical pressure.

For example, the first compressor (31) and the second compressor (41) may be of a single stage type.

For example, there may be provided two or more first utilization heat exchangers and two or more second utilization heat exchangers. For example, the first utilization heat exchanger may cool the interior of a freezer, or may be provided in an indoor unit dedicated to cooling.

The foregoing description concerns the embodiment and modifications, and it will be understood that numerous variations of modes and details may be made without departing from the gist and scope of the appended claims. The foregoing embodiment and modifications may be combined with one another or features thereof may be replaced with one another, as long as it does not impair the features of the present disclosure. The above-mentioned "first", "second", "third", . . . are just used to distinguish the words to which these terms are attached, and do not limit the number or order of the words.

INDUSTRIAL APPLICABILITY

As described above, the present disclosure is useful for a refrigeration device.

EXPLANATION OF REFERENCES

11 Refrigerant circuit
22 Outdoor heat exchanger (heat source heat exchanger)
30 Compression mechanism
31 First compressor
41 Second compressor
71 First flow path (flow path switching mechanism)
72 Second flow path (flow path switching mechanism)
73 Third flow path (flow path switching mechanism)
74 Fourth flow path (flow path switching mechanism)
75 First three-way valve (opening and closing mechanism, flow path switching mechanism)
76 Second three-way valve (opening and closing mechanism, flow path switching mechanism)
83 Refrigeration-facility heat exchanger (first utilization heat exchanger)
85 Heat exchanger (second utilization heat exchanger)
93 Indoor heat exchanger (second utilization heat exchanger)
100 Controller (control unit)
V1 First valve (opening and closing mechanism, flow path switching mechanism)
V2 Second valve (opening and closing mechanism, flow path switching mechanism)
V3 Third valve (opening and closing mechanism, flow path switching mechanism)
V4 Fourth valve (opening and closing mechanism, flow path switching mechanism)

The invention claimed is:

1. A refrigeration device comprising a refrigerant circuit to which a compression unit, a heat source heat exchanger, a first utilization heat exchanger and a second utilization heat exchanger connected in parallel to the heat source heat exchanger, and a flow path switching mechanism that switches flow of refrigerant are connected, wherein the flow path switching mechanism includes first to fourth flow paths an opening and closing mechanism that opens and closes the corresponding one of the flow paths, a first connection point connecting an inflow portion of the first flow path and an inflow portion of the second flow path is connected to a discharge portion of the compression unit, a second connection point connecting an outflow portion of the first flow path and an inflow portion of the third flow path is connected to a gas-side end of the heat source heat exchanger, a third connection point connecting an outflow portion of the second flow path and an inflow portion of the fourth flow path is connected to a gas-side end of the second utilization heat exchanger, and a fourth connection point connecting an outflow portion of the third flow path and an outflow portion of the fourth flow path, and a gas-side end of the first utilization heat exchanger are connected to a suction portion of the compression unit, a first gas line is provided which includes one end directly connected to the second connection point and the other end directly connected to the gas-side end of the heat source heat exchanger, and through which a gas refrigerant flows, and a second gas line is provided which includes one end directly connected to the third connection point and the other end directly connected to the gas-side end of the utilization heat exchanger, and through which a gas refrigerant flows.

2. The refrigeration device according to claim 1, wherein the refrigerant circuit is configured to perform a refrigeration cycle in which the opening and closing mechanism opens the first flow path and the second flow path and closes the third flow path and the fourth flow path, and refrigerant compressed in the compression unit radiates heat in the heat source heat exchanger and the second utilization heat exchanger and evaporates in the first utilization heat exchanger.

3. The refrigeration device according to claim 1, wherein the compression unit includes a first compressor and a second compressor, a suction portion of the first compressor is connected to the gas-side end of the first utilization heat exchanger, and a suction portion of the second compressor is connected to the gas-side end of the second utilization heat exchanger via the fourth flow path.

4. The refrigeration device according to claim 1, wherein the refrigerant in the refrigerant circuit is carbon dioxide.

5. The refrigeration device according to claim 1, wherein the refrigerant circuit is configured to perform a refrigeration cycle in which the opening and closing mechanism opens the second flow path and closes the first flow path and the fourth flow path, refrigerant compressed in the compression unit radiates heat in the second utilization heat exchanger and evaporates in the first utilization heat exchanger, and the heat source heat exchanger is stopped.

6. The refrigeration device according to claim 5, wherein the opening and closing mechanism includes a valve connected to the third flow path, and the refrigeration device includes a control unit that closes the valve of the third flow path during the refrigeration cycle.

7. The refrigeration device according to claim 1, wherein the opening and closing mechanism includes a valve connected to at least one of the first flow path, the second flow path, the third flow path, and the fourth flow path, and the valve is configured to open and close the corresponding one of the flow paths.

8. The refrigeration device according to claim 7, wherein the opening and closing mechanism includes four valves respectively connected to the first flow path, the second flow path, the third flow path, and the fourth flow path.

9. The refrigeration device according to claim 7, wherein the opening and closing mechanism includes at least one of a first three-way valve provided at the second connection point and a second three-way valve provided at the third connection point, the first three-way valve is configured to be switched between a first state where the second connection point communicates with the first connection point and is closed off from the fourth connection point, and a second state where the second connection point communicates with the fourth connection point and is closed off from the first connection point, and the second three-way valve is configured to be switched between a first state where the third connection point communicates with the fourth connection point and is closed off from the first connection point, and a second state where the third connection point communicates with the first connection point and is closed off from the fourth connection point.

10. The refrigeration device according to claim 7, wherein the refrigerant circuit is configured to perform a refrigeration cycle in which the opening and closing mechanism opens the second flow path and closes the first flow path and the fourth flow path, refrigerant compressed in the compression unit radiates heat in the second utilization heat exchanger and evaporates in the first utilization heat exchanger, and the heat source heat exchanger is stopped.

11. The refrigeration device according to claim 7, wherein the valve includes a flow rate adjustment valve having an adjustable opening degree.

12. The refrigeration device according to claim 11, wherein the opening and closing mechanism includes four valves respectively connected to the first flow path, the second flow path, the third flow path, and the fourth flow path.

13. The refrigeration device according to claim 11, wherein the opening and closing mechanism includes at least one of a first three-way valve provided at the second connection point and a second three-way valve provided at the third connection point, the first three-way valve is configured to be switched between a first state where the second connection point communicates with the first connection point and is closed off from the fourth connection point, and a second state where the second connection point communicates with the fourth connection point and is closed off from the first connection point, and the second three-way valve is configured to be switched between a first state where the third connection point communicates with the fourth connection point and is closed off from the first connection point, and a second state where the third connection point communicates with the first connection point and is closed off from the fourth connection point.

14. The refrigeration device according to claim 11, wherein the flow rate adjustment valve is connected to the third flow path.

15. The refrigeration device according to claim 14, wherein the opening and closing mechanism includes four valves respectively connected to the first flow path, the second flow path, the third flow path, and the fourth flow path, wherein at least one of the four valves includes the flow rate adjustment valve.

16. The refrigeration device according to claim 14, wherein the opening and closing mechanism includes at least one of a first three-way valve provided at the second connection point and a second three-way valve provided at the third connection point, the first three-way valve is configured to be switched between a first state where the second connection point communicates with the first connection point and is closed off from the fourth connection point, and a second state where the second connection point communicates with the fourth connection point and is closed off from the first connection point, and the second three-way valve is configured to be switched between a first state where the third connection point communicates with the fourth connection point and is closed off from the first connection point, and a second state where the third connection point communicates with the first connection point and is closed off from the fourth connection point.

17. The refrigeration device according to claim 11, wherein the flow rate adjustment valve is connected to the first flow path.

18. The refrigeration device according to claim 17, wherein the opening and closing mechanism includes another flow rate adjustment valve connected to the third flow path.

19. The refrigeration device according to claim 17, wherein the opening and closing mechanism includes four valves respectively connected to the first flow path, the second flow path, the third flow path, and the fourth flow path, wherein at least one of the four valves includes the flow rate adjustment valve.

20. The refrigeration device according to claim 17, wherein the opening and closing mechanism includes at least one of a first three-way valve provided at the second connection point and a second three-way valve provided at the third connection point, the first three-way valve is configured to be switched between a first state where the second connection point communicates with the first connection point and is closed off from the fourth connection point, and a second state where the second connection point communicates with the fourth connection point and is closed off from the first connection point, and the second three-way valve is configured to be switched between a first state where the third connection point communicates with the fourth connection point and is closed off from the first connection point, and a second state where the third connection point communicates with the first connection point and is closed off from the fourth connection point.

* * * * *